US007124616B2

(12) United States Patent
Kawamoto

(10) Patent No.: US 7,124,616 B2
(45) Date of Patent: Oct. 24, 2006

(54) WORK TRANSFER METHOD FOR TRANSFER PRESS AND WORK TRANSFER APPARATUS FOR TRANSFER PRESS OR PRESS

(75) Inventor: Kiichirou Kawamoto, Komatsu (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 10/280,972

(22) Filed: Oct. 25, 2002

(65) Prior Publication Data

US 2003/0084701 A1 May 8, 2003

(30) Foreign Application Priority Data

Nov. 8, 2001 (JP) ..... 2001-343008
Jan. 15, 2002 (JP) ..... 2002-005784

(51) Int. Cl.
*B21D 43/05* (2006.01)

(52) U.S. Cl. ..... 72/405.11; 72/405.1; 72/405.01; 198/621.1

(58) Field of Classification Search ..... 72/405.16, 72/405.1, 405.11, 405.09, 405.01; 198/621.1
See application file for complete search history.

(56) References Cited

U.S. PATENT DOCUMENTS 3,834,213 A 9/1974 Henzler et al
4,621,516 A 11/1986 Schafer et al.
5,072,823 A * 12/1991 Takahashi et al. ..... 198/468.4
5,159,827 A * 11/1992 Shiraishi et al. ..... 72/405.1
5,632,181 A * 5/1997 Vanderzee et al. ..... 72/405.1
5,722,283 A * 3/1998 VanderZee et al. ..... 72/405.1
5,737,960 A * 4/1998 Brandstetter et al. .... 72/405.16
5,979,212 A * 11/1999 VanderZee et al. ..... 72/405.09
6,701,769 B1 * 3/2004 Shiroza ..... 72/405.1

FOREIGN PATENT DOCUMENTS

JP 62-227534 A 6/1987
JP 3-51929 U 5/1991
JP 3-126300 U 12/1991
JP 07-073756 8/1995
JP 09-108751 A 1/1997
JP 10-314871 A 12/1998
JP 11-104759 A 4/1999

* cited by examiner

*Primary Examiner*—Daniel C. Crane
(74) *Attorney, Agent, or Firm*—Frishauf, Holtz, Goodman & Chick, P.C.

(57) ABSTRACT

A work transfer apparatus for a transfer press or a press, with which an optimal die can be designed for each process, is provided. For this purpose, the work transfer apparatus for a transfer press includes at least a pair of lift beams (13), carriers (15) movable along a longitudinal direction of the lift beam, paired sub-carriers (50) movable in a carrier moving direction, power transmission means (51, 54) for transmitting carrier driving force to the sub-carriers, and a cross bar (17) which is laterally spanned between the sub-carriers and provided with work holding means (18) capable of holding a work.

17 Claims, 25 Drawing Sheets

WORK TRANSFER METHOD FOR TRANSFER PRESS AND WORK TRANSFER APPARATUS FOR TRANSFER PRESS OR PRESS

TECHNICAL FIELD

The present invention relates to a work transfer method for a transfer press, and a work transfer apparatus for a transfer press or a press.

BACKGROUND ART

A transfer feeder for transferring a work between the working stations in succession is conventionally placed in a transfer press including a plurality of working stations in a press main body. The transfer feeder includes a pair of parallel transfer bars at left and right with respect to a work transfer direction, and each of the transfer bars has a long length to extend along all the working stations.

As a conventional transfer feeder, the one is disclosed in, for example, in Japanese Patent Laid-open No. 11-104759, and according to the Laid-open Patent, a pair of left and right transfer bars are constituted by long integrated bars extending along all the working stations. The transfer bar is provided with a plurality of suction tools with predetermined spaces from each other in the work transfer direction to be ascendable and descendable, and movable in the lateral direction (clamp direction) and the longitudinal direction (transfer direction) by a linear motor. As a result, it is made possible to correspond to a change of the work in the clamp/unclamp direction by the aforementioned suction tools when transferring a work.

As another example of the prior art of the transfer feeder, for example, the one disclosed in Japanese Patent Laid-open No. 10-314871 is cited. According to the Laid-open Patent, in the transfer feed bar drive device, the transfer bar (feed bar of the same Laid-open Patent) includes a feed carrier, to which the transfer bar is connected so as to be movable up and down and in the lateral direction and restricted in the movement in the longitudinal direction, and a feed unit for moving the feed carrier back and forth by a linear motor.

As still another example of the prior art of the transfer feeder, the one is disclosed in for example, Japanese Patent Publication No. 7-73756. According to the same Patent Publication, a plurality of carriers are provided at a pair of vertically movable guide rails at left and right with respect to the work transfer direction (corresponding to the aforementioned transfer bar) to be independently movable by a linear motor. The cross bar is spanned between the carriers opposing each other with each working station between them, a work is sucked with the work holding means including the cross bar, and the cross bar is moved along the guide rail by the aforementioned linear motor, whereby the work is transferred.

However, the above-described conventional transfer bar has the following problems.

The transfer bars described in Japanese Patent Laid-open No. 11-104759 and Japanese Patent Laid-open No. 10-314871 are each constituted by an integrated bar extending along all the working stations, and there is only one system of the driving source in the feed direction. Consequently, adjustment of each stroke of the feed, lift, and work transfer height (so-called feed level) of each process has limitation to some extent. Namely, concerning the feed stroke, the transfer pitch (distance between the processes) is constant, and therefore the work transfer is difficult in the transfer press in which the pitches between the adjacent working stations differ. In addition, the die has to be designed so that the distances between the processes are equal, which causes the problem that it is difficult to design an optimal die in consideration of the interference curve and the like. Further, concerning the lift and work transfer height, they have to be equal between the respective working stations, which makes it difficult to design an optimal die corresponding thereto.

The transfer bar described in Japanese Patent Publication No. 7-73756 is constituted so that a plurality of carriers can be self-propelled independently by the respective linear motors. However, there arises the problem that the lift stroke and the work transfer height cannot be adjusted for each process since the transfer bars (guide rails) are constituted by integrated bars extending along a plurality of working stations as described above.

SUMMARY OF THE INVENTION

The present invention is made in view of the above-described problems, and has its object to provide a work transfer method and a work transfer apparatus for a transfer press, which is capable of individually adjusting a feed stroke, a lift stroke and work transfer height for each process, and with which an optimal die can be designed for each process. The present invention has another object to provide a work transfer apparatus for a press which is capable of individually adjusting the feed stroke for each process, and facilitating work transfer with different pitches between adjacent working processes. Further, it has still another object to provide a work transfer apparatus for a press which is capable of individually adjusting the lift stroke and the work transfer height for each pair of lift beams, and with which an optimal die can be designed.

In order to attain the above-described object, a work transfer method for a transfer press according to the present invention includes the steps of carrying out a process of moving at least a pair of lift beams, which are provided in parallel with a work transfer direction, up and down, and a process of reciprocatingly moving a cross bar, which is laterally spanned between the carriers at least a pair of which are provided at each pair of lift beams to oppose each other, moves each pair of carriers along a longitudinal direction of the lift beam, and is provided with work holding means capable of holding a work, based on a predetermined feed motion, and at a time of moving the carriers, by utilizing movement of at least a pair of carriers out of the carriers, moving the cross bar, which is laterally spanned between the utilized pair of carriers, to a position that is offset in a moving direction of the utilized pair of carriers with respect to a moved position of the utilized pair of carriers.

According to the above method, at least a pair of lift beams are individually moved up and down, and the carriers provided at the lift beams are individually moved in the longitudinal direction of the lift beam (work transfer direction). At least a pair of carriers opposing each other moves the cross bar, which is laterally spanned between both the carriers, and is provided with the work holding means capable of holding the work, in the carrier moving direction by utilizing the movement of the carriers when the carriers moving. As a result, rising and lowering stoke and the feed stroke in the transfer direction can be adjusted for each of the lift beams. Consequently, the rising and lowering stroke and the feed stroke in the transfer direction of the cross bar can be adjusted for each area between the adjacent working stations, and the timing of feed motion can be changed, thus making it possible to perform work transfer even in the case in which the transfer pitches between the working stations differ, and making it possible to set a die interference curve corresponding to a die for each area between the working stations. An origin position (feed level) of each working station can be set at a position corresponding to the die. As a result, an optimal die can be designed. Even in the case in which there is a process with a longer transfer pitch than the others between a plurality of working stations, work transfer can be performed without providing an idle station and the length of the entire transfer press line can be made shorter.

Further, since offset of the cross bar is driven by utilizing the movement of the carriers at the time of moving the carriers, a driving source for offset drive is not necessary, and the number of components of the carrier is small, thus making it possible to reduce the weight and size. Since at least a pair of carriers move the cross bar to the position that is offset from the carrier moved position, the carrier is moved near to the end portion in the longitudinal direction of the lift beam. As a result, the cross bar can be moved to the position past the end portion in the longitudinal direction of the lift beam. Accordingly, even when a plurality of lift beams are linearly placed along the work transfer direction (longitudinal direction of the lift beam) so that there is no overlapping spot, the cross bar and the work holding means can be moved to substantially the central position of the working station provided between the adjacent lift beams. Consequently, the feed stroke can be set without being restricted by the length of the cross bar, and the length of the cross bar can be constituted to be short.

In the work transfer method for the transfer press, the offset position is a position in which the cross bar, which is laterally spanned between the utilized pair of carriers, exceeds end portions of the lift beams, which are provided at the utilized pair of carriers, outward, when the utilized pair of carriers are moved to substantially the end portions in a longitudinal direction of the lift beams.

According to the above method, the following effects are further provided other than the effects according to the above-described method. The carrier movable to substantially the end portion in the longitudinal direction of the lift beam offsets the sub-carrier provided at the carrier when the carrier moves to the end portion. As a result, the cross bar is moved to the position in which the cross bar exceeds the end portion of the lift beam outward. Consequently, a plurality of lift beams are placed subsequently in line in the work transfer direction, and even in the case in which the working station exists between the adjacent lift beams, transfer to the working station can be performed with reliability, and limitation in the transfer pattern is eliminated. For example, when a carrying-in device, carrying-out device or the like is placed at the upstream side or the downstream side of the working station, work transfer can be performed correspondingly to various kinds of carrying-in devices and carrying-out devices without being limited by the length of the lift beam in the transfer direction. Therefore, the degree of freedom of the process design of the transfer press line is increased.

A first aspect of the work transfer apparatus for the transfer press according to the present invention has the constitution including at least a pair of lift beams provided in parallel with a work transfer direction to be movable up and down, carriers at least a pair of which are provided at each pair of lift beams respectively, and which are movable along a longitudinal direction of the lift beam, paired sub-carriers which are provided along guides provided on at least a pair of the carriers out of the carriers at least a pair of which are provided thereat respectively and are movable in a carrier moving direction, power transmission means which utilizes movement of each pair of carriers when they are moved, and transmits carrier driving force to each pair of sub-carriers, respectively, and a cross bar which is laterally spanned between each pair of sub-carriers opposing each other, and is provided with work holding means capable of holding a work.

According to the first constitution, at least a pair of lift beams are individually moved up and down, and the carriers provided at the lift beams are individually moved in the longitudinal direction of the lift beam (work transfer direction). The sub-carriers provided at the carriers are moved in the carrier moving direction via the power transmission mechanism by utilizing the movement of the carriers at the time of moving the carriers. Thereby, it is possible to adjust the rising and lowering stroke and the feed stroke in the transfer direction of the cross bar which is laterally spanned between a pair of sub-carriers opposing each other and is provided with the work holding means capable of holding a work.

Consequently, the rising and lowering stroke and the feed stroke in the transfer direction of the cross bar can be adjusted for each area between the adjacent working stations, and the timing of the feed motion can be changed. Accordingly, the work transfer can be performed even in the case in which the transfer pitches between the working stations differ, and the die interference curve corresponding to the die can be set for each area between the working stations. The origin position (feed level) of each of the working stations can be set at the position corresponding to the die. Accordingly, work transfer can be performed without providing an idle station, the length of the entire transfer press line can be made short, and an optimal die can be designed.

Further, the carrier driving force is transmitted to the sub-carrier via the power transmission means by utilizing the movement of the carrier when the carrier is moved. As a result, the sub-carrier and the cross bar can be moved by being offset from the carrier, and therefore a driving source for driving the sub-carrier is necessary, thus making it possible to reduce the weight and size of the carrier and sub-carrier. Since the carrier moves the sub-carrier and the cross bar to the position that is offset from the carrier moved position, the cross bar can be moved to the position past the end portion in the longitudinal direction of the lift beam as in the explanation of the above-described method. Consequently, the feed stroke can be set without being restricted by the length of the cross bar, and therefore it can be constituted that the process design is facilitated and the length of the cross bar is made short.

A second aspect of the work transfer apparatus for the transfer press according to the present invention has the constitution in which "carriers which are movable along the longitudinal direction of the lift beam" in the first constitution is made "carriers which are driven by the linear motor to be movable along the longitudinal direction of the lift beam".

In the above second constitution, the drive means of the carrier in the first constitution is made a linear motor. As the effects according to this, the driving source of the carrier can be reduced in size and weight, and vibration resistance can be improved. The other effects are the same as the effects in the first constitution.

Further, in the work transfer apparatus for the transfer press, the cross bar may be laterally spanned directly between another pair of carriers out of the carriers at least a pair of which are provided thereat respectively.

The above constitution is applicable to the case in which the transfer pitch between the working stations is larger than the transfer pitch between the other working stations. For example, in the working station (W1) at the uppermost stream side of the transfer press, a blank material is worked, and therefore the size of the die becomes larger as compared with the sizes of the dies of the following processes. Accordingly, the transfer pitch between the working station (W1) and the working station (W2) becomes larger than the transfer pitches between the working stations of the following processes. In this case, a pair of carriers including the sub-carriers between which the cross bar is laterally spanned and opposing each other are provided in the transfer area between the working stations with the larger transfer pitch. As a result, a larger feed stroke can be set than in the transfer areas between the other working stations provided with the carriers between which the cross bar is directly spanned laterally, and therefore it is possible to design an optimal die in consideration of the die interference curve.

A pair of carriers opposing each other and including the sub-carriers between which the cross bar is laterally spanned are provided only the lift beams corresponding to the working station in need of them as described above, whereby the cost can be reduced as necessary. Further, in the transfer press in which uprights exist between the working stations, for example, idle stations are provided at the upright parts. In the case in which the transfer to the next working station cannot be performed unless the transfer is performed via the idle station, it is made possible to transfer a work without providing the idle stations by mounting the carriers including the sub-carriers to which the cross bar is connected and making the feed stroke larger.

In the work transfer apparatus for the transfer press, the guides may protrude in a carrier moving direction from end portions of the lift beams to guide the sub-carriers, when at least a pair of carriers out of the carriers provided with the sub-carriers are moved up to substantially the end portion in the longitudinal direction of the lift beam.

According to the above constitution, when the carriers are moved up to the area in the vicinity of the end portion in the longitudinal direction of the lift beam, the guides for guiding the sub-carriers protrude in the carrier moving direction from the aforementioned end portion of the lift beam. Therefore, the sub-carriers can be moved to the position past the end portion of the lift beam outward with reliability. Consequently, the work transfer can be also performed with reliability in the transfer press in which the adjacent lift beams are spaced in the working transfer direction and the working stations are set at spaces between the lift beams, and therefore general versatility of the present work transfer apparatus (transfer feeder) is large.

In the work transfer apparatus for the transfer press, the power transmission means may include a first rack which is provided at the lift beam along the longitudinal direction of the lift beam, a first pinion which is meshed with the first rack and rotatably supported by the carrier, a second rack which is provided at the sub-carrier along the longitudinal direction of the lift beam, a second pinion which is meshed with the second rack and rotatably supported by the carrier, and rotational force transmission means which transmits a rotational force of the first pinion to the second pinion.

According to the above constitution, the power transmission means for transmitting the driving force of the carrier to the sub-carrier is constituted by the combination of the racks and pinions, and therefore power transmission can be performed with reliability with a simple constitution. In this situation, the total moving distance of the sub-carrier from the reference point can be obtained by adding up the moving distance of the carrier and the offset distance of the carrier with respect thereto. The off set distance of the sub-carrier with respect to the moving distance of the carrier can be obtained based on the transmission ratio of the power transmission means and the organizational design parameter, and therefore the position of the sub-carrier, that is, the position of the work holding means can be accurately controlled by controlling the moving distance of the carrier.

In the work transfer apparatus of the transfer press, the power transmission means may include a rack which is provided at the lift beam along the longitudinal direction of the lift beam, a pinion which is meshed with the rack and rotatably supported by the carrier, a shaft which is provided at the carrier along the longitudinal direction of the lift beam, rotatably supported, and has a male thread on an outer circumference, a nut which is provided at the sub-carrier and screwed in the shaft, and rotational force transmission means for transmitting a rotational force of the pinion to the shaft.

According to the above constitution, the power transmission means is constituted by gears such as the rack and the pinion, the other rotational force transmission means, the shaft provided with a male thread engraved on its outer circumference and the nut screwed in the shaft, and therefore power transmission can be performed with reliability with a simple constitution. In this constitution, the position of the work holding means can be accurately controlled as in the above-described power transmission means.

In the work transfer apparatus for the transfer press, the power transmission means may include a rack which is provided at the lift beam along the longitudinal direction of the lift beam, a pinion which is meshed with the rack and rotatably supported by the carrier, a deformation gear, in which a teeth part of the gear is provided by being engraved on an outer arc portion of a sector, the teeth part is meshed with either the pinion or an idle gear for transmitting a rotational force of the pinion, and a shaft included at a center of the sector arc is rotatably supported at the carrier, a first lever with one end being rotatably attached to the sub-carrier and the other end being rotatably supported at the carrier movably only in an up-and-down direction, and a second lever with one end being fixed to a rotary shaft of the deformation gear and the other end being rotatably attached between both end axes of the first lever by means of a shaft.

According to the above constitution, the power transmission means is constituted by the rack, the pinion, the deformation gear which is meshed with the pinion or the idle gear for transmitting the rotational force of the pinion, and the two levers for connecting the sub-carrier, carrier and the deformation gear with pins, and therefore power transmission can be performed with reliability with a comparatively simple constitution. In this constitution, the position of the work holding means can be accurately controlled as in the above-described power transmission means.

In the work transfer apparatus for the transfer press, the power transmission means includes a rack which is provided at the lift beam along the longitudinal direction of the lift beam, a pinion which is meshed with the rack and rotatably supported by the carrier, a first pulley fixed to the pinion with a same shaft, second pulleys rotatably supported at substantially both end regions of the carrier in the longitudinal direction of the lift beam, and an endless belt which is wound around the first pulley and the second pulleys, and the sub-carrier is connected to the endless belt between the second pulleys.

According to the above constitution, the power transmission means is constituted by the rack, the pinion, the first pulley, the second pulley and the endless belt, and therefore power transmission can be made with reliability with a simple constitution. In this situation, the position of the work holding means can be accurately controlled as the above-described power transmission means. In this constitution, the position of the work holding means can be accurately controlled as the above-described power transmission means.

A first aspect of a work transfer apparatus for a press according to the present invention may have a constitution, in a work transfer apparatus for a press for transferring a work within the press or between the presses, including at least a pair of lift beams which are placed in parallel with a work transfer direction at left and right with respect to the work transfer direction, and are provided to be movable up and down, carriers at least a pair of which are provided at each pair of lift beams respectively, and which are movable along a longitudinal direction of the lift beam, paired sub-carriers which are provided along guides provided on at least a pair of the carriers out of the carriers at least a pair of which are provided thereat respectively and are movable by a linear motor in a carrier moving direction, and a cross bar which is laterally spanned between each pair of sub-carriers opposing each other, and is provided with work holding means capable of holding a work.

According to the above constitution, the sub-carriers are provided to be individually movable in the carrier moving direction, and therefore the moving distance of the cross bar, that is, the work transfer distance can be optionally set by adding up each stroke of the carrier and the sub-carrier. Therefore, by offsetting the sub-carrier with respect to substantially the middle position of the carrier, a longer feed stroke of the cross bar than the feed stroke in the work transfer direction of the carrier single body can be realized.

Accordingly, the feed stroke can be also adjusted by the sub-carrier in the work transfer apparatus in which a long lift beam along the entire station is provided, the carriers are connected to each other, and each of the carriers makes the same stroke with the same motion with one feed drive means, and work transfer with the different pitches between the adjacent working stations can be easily performed.

Further, by driving the sub-carrier by means of the linear motor, the work transfer apparatus can be reduced in weight and size. Therefore, the capacity of the other driving sources in the work transfer apparatus can be made smaller, the production cost is made low, the chattering of the bars at the time of actuation, stoppage and inching can be reduced, and the durability of each component of the work apparatus can be increased. Further, increase in speed and positional accuracy by the linear motor can be attained, and therefore even when there is a spot with larger transfer pitch between the working stations than the other spots, slaved following can be sufficiently performed, thus making it possible to correspond to a high-speed operation of the press.

Further, by dividing the lift beam, the rising and lowering stroke and the feed stroke in the transfer direction of the work holding means and the cross bar can be independently set for each lift beam. Consequently, the rising and lowering stroke and the feed stroke in the transfer direction of the cross bar can be adjusted for each area between the adjacent working stations, and the timing of the feed motion can be changed, thus making it possible to set the work transfer corresponding to the die for each area between the working stations. The origin position (feed level) in the up-and-down direction for each working station can be set at the position corresponding to the die. As a result of this, an optimal die can be designed.

A second aspect of the work transfer apparatus for the press has, in a work transfer apparatus for a press for transferring a work within the press or between the presses, a constitution including at least one lift beam, which is placed in parallel with a work transfer direction and at substantially a center in a lateral direction with respect to the work transfer direction, and is made movable up and down, outside a press working area, a carrier at least one of which is provided at each lift beam, and which is movable along a longitudinal direction of the lift beam, a sub-carrier which is provided along a guide provided on each carrier and movable by a linear motor in a carrier moving direction, and work holding means which is provided at each sub-carrier and capable of holding a work, or a cross bar which is provided at each sub-carrier and has the aforementioned work holding means.

According to the above constitution, it is the constitution in which "at least one lift beam at substantially a center in a lateral direction with respect to the work transfer direction" is placed instead of "at least a pair of lift beams which are placed at left and right with respect to the work transfer direction". The same effects can be obtained in the above constitution, and the constitution of the work transfer apparatus can be simplified and made compact.

In the work transfer apparatus for the press, the cross bar may be laterally spanned directly between another pair of carriers out of the carriers at least a pair of which are provided thereat respectively.

According to the above constitution, the carrier positions out of a plurality of carriers, in which the sub-carriers are provided, may be determined and constituted according to the amount of necessity of the degree of freedom of the die design, the necessity of the large feed stroke and the like. Namely, the work transfer distances can be set optionally by the feed stroke of only the carrier and adding up of the strokes of the carrier and the sub-carrier. For example, there is the case in which the transfer pitch between certain working stations is larger than the transfer pitch between the other working stations. In this case, a pair of carriers opposing each other, which include the sub-carriers between which the cross bar is laterally spanned, are provided in the transfer area between the working stations with the larger transfer pitch. Thereby, a larger feed stroke than in the transfer area between the other working stations provided with the carriers between which the cross bar is directly spanned laterally can be set, and therefore it is possible to design an optimal die. As described above, by providing a pair of carriers opposing each other, which include the sub-carriers between which the cross bar is laterally spanned, only at the lift beams corresponding to the working station in need of them, the cost can be reduced as necessary.

In the work transfer apparatus for the press, the guides, which guide the sub-carriers, may protrude in the carrier moving direction from end portions of the lift beams, when at least a pair of (or one of) the carriers are moved up to substantially the end portion in the longitudinal direction of the lift beam.

According to the above constitution, when the carrier is moved up to the end portion of the lift beam, the sub-carriers and the cross bar can be moved to the position past outward in the carrier moving direction from the end portion of the lift beam. Consequently, the work transfer distance can be set without being restricted by the length of the lift beam, the process design is facilitated, and the length of the lift beam can be constituted to be small. Further, even in the case in which a plurality of lift beams are placed in series in the longitudinal direction, and the adjoining parts of the adjacent lift beams are located at substantially the center (die) of the working station, the cross bar can be moved to substantially the center of the working station with reliability.

A third aspect of the work transfer apparatus for the press has, in a work transfer apparatus for a press for transferring a work within the press or between the presses, a constitution including at least a pair of lift beams which are placed in parallel with a work transfer direction at left and right with respect to the work transfer direction, and are provided to be movable up and down, carriers at least a pair of which are provided at each pair of lift beams respectively, and which are movable along a longitudinal direction of the lift beam, paired sub-carriers which are provided along guides provided on at least a pair of the carriers out of the carriers at least a pair of which are provided thereat respectively, and movable in a carrier moving direction, and a cross bar which is laterally spanned between each pair of sub-carriers opposing each other, and is provided with work holding means capable of holding a work, in which the aforementioned guides, which guide the sub-carriers, protrude in the carrier moving direction from end portions of the aforementioned lift beams, when at least a pair of the carriers are moved up to substantially the end portion in the longitudinal direction of the lift beam.

According to the above constitution, even though the drive means for the sub-carrier is not the linear motor, for example when it is the drive of a servo motor, or when the sub-carrier is moved by following the movement of the carrier with use of pulleys and a belt without having an individual driving source of the sub-carrier itself, the same effects as described above can be obtained.

A fourth aspect of the work transfer apparatus for the press has, in a work transfer apparatus for a press for transferring a work within the press or between the presses, a constitution including at least one lift beam, which is placed in parallel with a work transfer direction and at substantially a center in a lateral direction with respect to the work transfer direction, and is made movable up and down, outside a press working area, a carrier at least one of which is provided at each lift beam, and which is movable along a longitudinal direction of the lift beam, a sub-carrier which is provided along a guide provided on each carrier and movable in a carrier moving direction, and work holding means which is provided at each sub-carrier and capable of holding a work, in which a guide, which guides the sub-carrier, protrudes in the carrier moving direction from an end portion of the lift beam, when at least one of the carrier is moved up to substantially the end portion in the longitudinal direction of the lift beam.

The above constitution is the constitution in which at least one lift beam is placed at substantially the center in the lateral direction instead of at least a pair of lift beams provided at left and right with respect to the work transfer direction in the above-described third constitution. In this case, the same effects as in the third constitution can be obtained and the constitution of the work transfer apparatus can be simplified and made compact.

BEST MODE FOR CARRYING OUT THE INVENTION

Preferred embodiments of the present invention will be explained in detail below with reference to the drawings.

Figure 1:
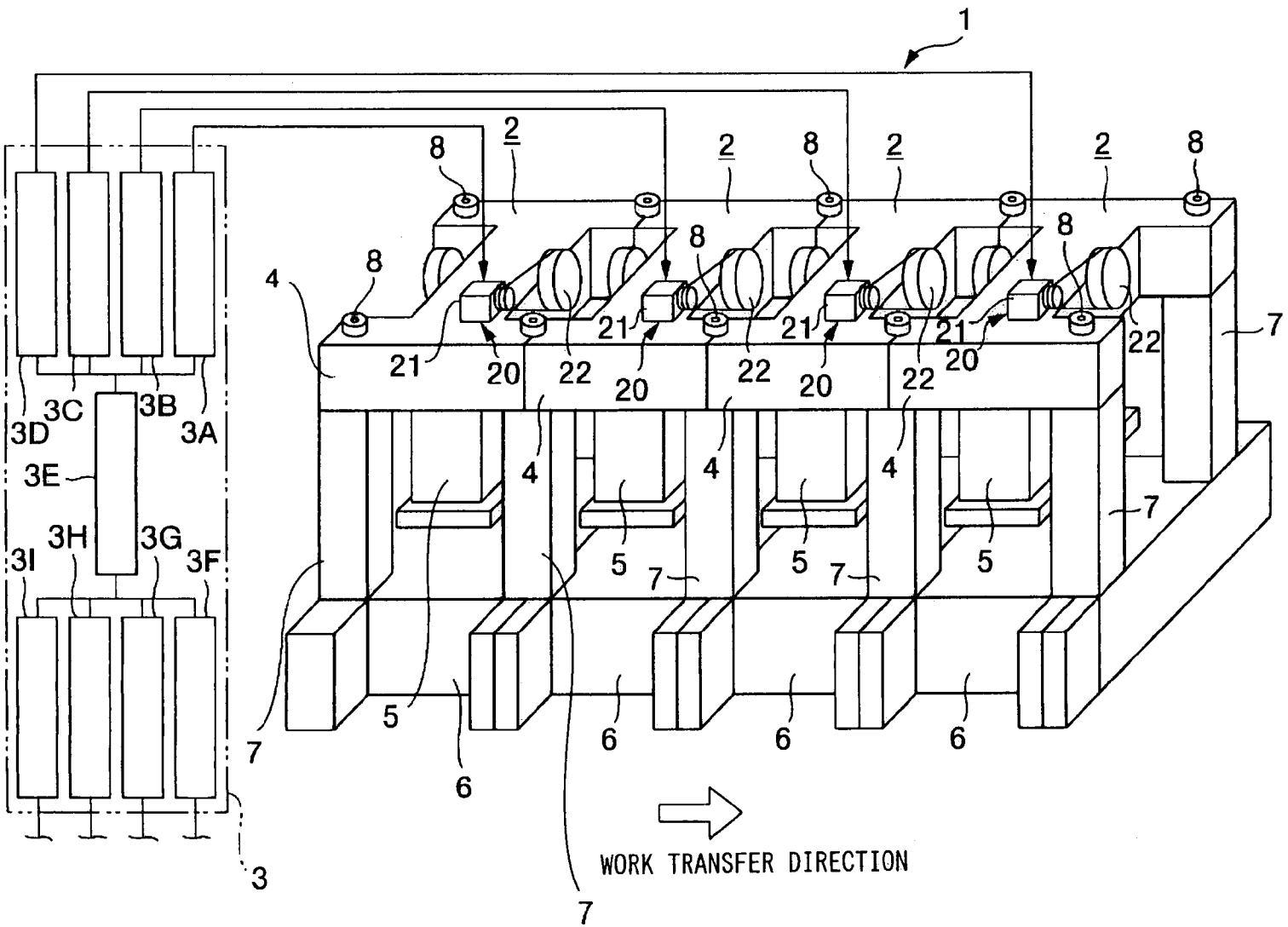
FIG. 1 is an entire perspective view schematically showing a transfer press to which the present invention is applied.
Figure 2:
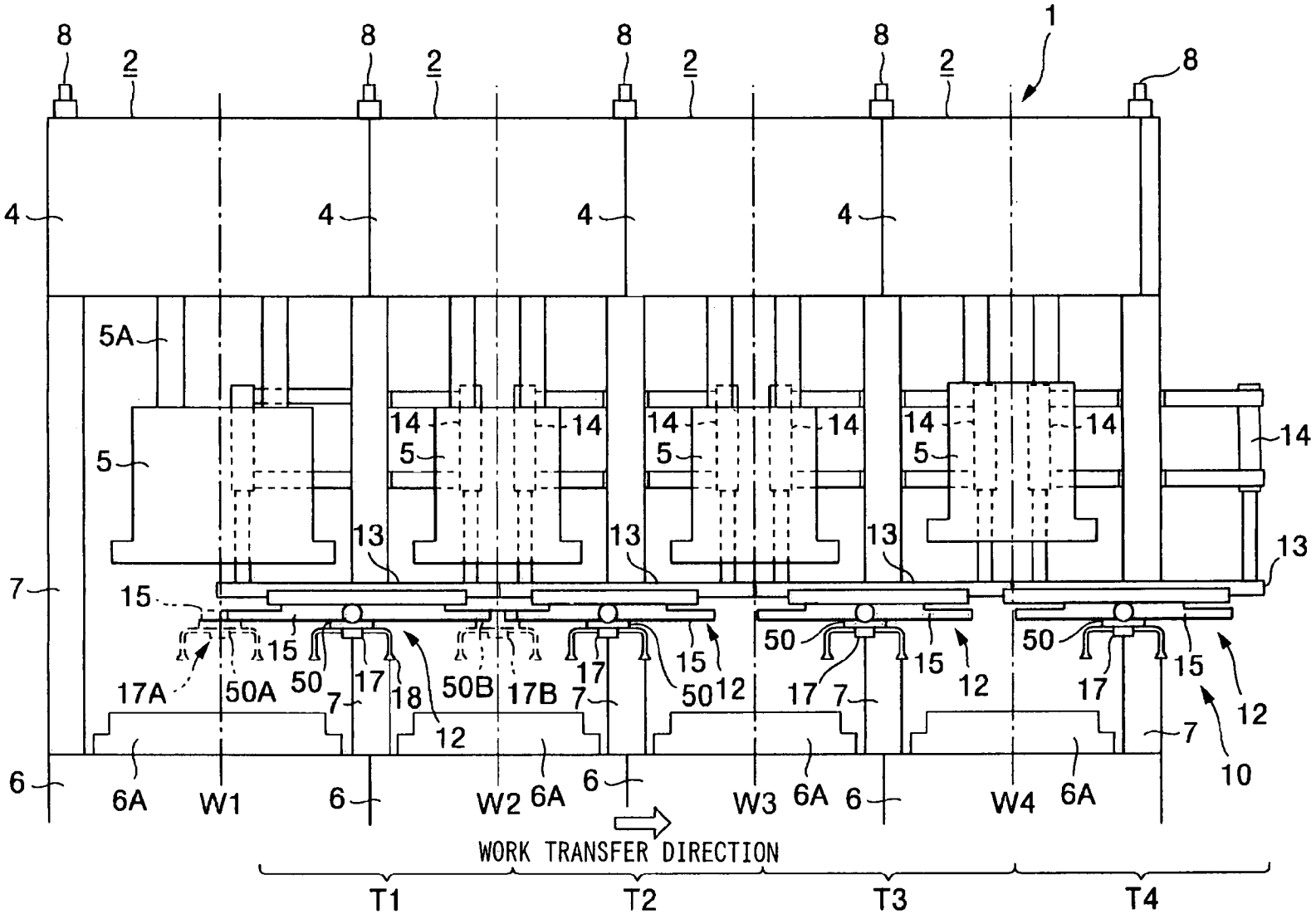
FIG. 2 is a front view of FIG. 1.
Figure 3:
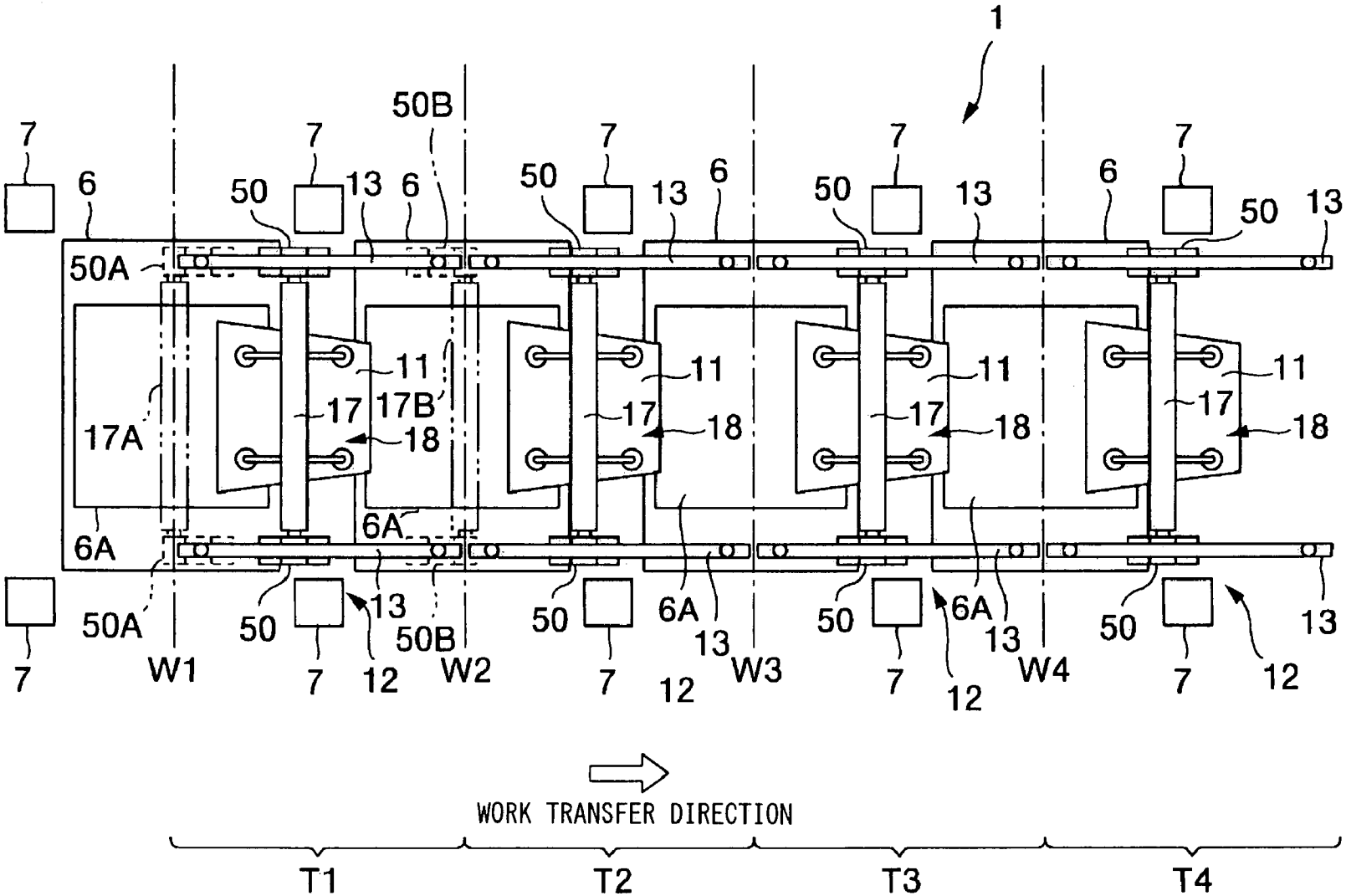
FIG. 3 is a sectional plan view of FIG. 2.
Figure 4:
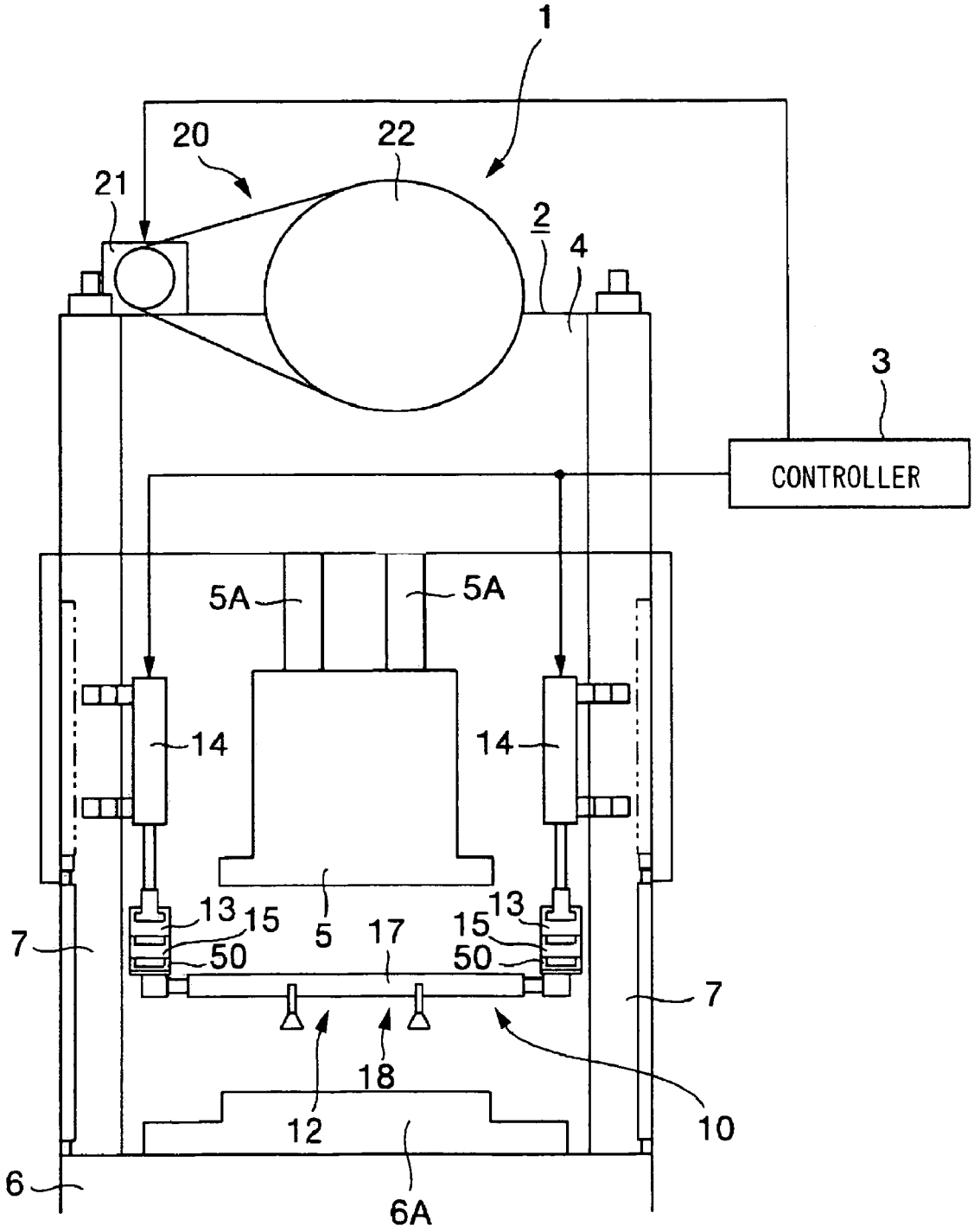
FIG. 4 is a side view of FIG. 2.

First, a transfer press will be explained based on FIG. 1 to FIG. 4. FIG. 1 is an entire perspective view schematically showing the transfer press to which the present invention is applied. FIG. 2 is a front view of the transfer press in FIG. 1, and is a view showing an operation state of a transfer feeder. FIG. 3 and FIG. 4 are a sectional plan view and a side view of the transfer press, respectively. In the first to fifth embodiments that will be described later, this transfer press is used.

In FIG. 1 and FIG. 4, a transfer press 1 is constituted by arranging a plurality (four in this embodiment) of press units 2, which are fabricated into a module, along a work transfer direction, and includes working stations W1 to W4 corresponding to the respective press units 2. The transfer press 1 includes a controller 3 as control means having a control panel and an operation panel (both are not shown), a stacker device (not shown) for supplying works, a transfer feeder 10 and the like. In this transfer press 1, the left side of the drawings is an upstream of transfer of a work 11, and a right side is a downstream of the transfer.

Each of the press units 2 constituting the transfer press 1 includes a crown 4, in which a slide driving force transmission mechanism is incorporated, a slide 5, which is connected to the aforementioned slide driving force transmission mechanism via a plunger 5A and is mounted with an upper die (not shown), and a bed 6 provided with a bolster 6A mounted with a lower die (not shown). As for the bolster 6A, a moving bolster, or an ordinary bolster fixed to the bed 6 can be used.

Each of a pair of uprights 7 and 7 are vertically provided between the adjacent press units 2 and 2, and at end portions of the press units 2 at the uppermost stream side and the lowermost stream side in the work transfer direction to oppose each other laterally with respect to the work transfer direction in the plan view. A tie rod 8 for firmly connecting the crown 4, the bed 6 and the upright 7 vertically penetrates inside each of the uprights 7. As shown in FIG. 1 and FIG. 4, each of the slides 5 is driven by a slide drive section 20 having a main motor 21 provided at each of the press units 2, a fly wheel 22 rotationally driven by the main motor 21 and the like.

The controller 3 includes an arithmetic unit such as a microcomputer and high-speed numeric processor, and controls each of the slide drive sections 20 to drive the slide 5. In addition, the controller 3 controls each lift drive means, carrier drive means and work holding means that will be described later to drive the transfer feeder 10. The controller 3 includes W1 to W4 control means 3A to 3D each for controlling the slide drive section 20 for each of the press units 2, and general control means 3E for generally controlling the W1 to W4 control means 3A to 3D. Each of the W1 to W4 control means 3A to 3D has the equivalent function to the control means of an ordinary single press, and controls the slide drive section 20 of the corresponding working station W1 to W4 irrespective of the other slide drive sections 20 to drive each of the slides 5 independently.

The general control means 3E controls the W1 to W4 control means 3A to 3D corresponding to each of the slides 5 according to a work working process and each slide motion corresponding to it, and thereby it controls the slide drive section 20 of the working stations (W1 to W4) corresponding to the respective control means 3A to 3D to drive the slides 5 synchronously with each other. The controller 3 includes T1 to T4 control means 3F to 3I for controlling the transfer feeder 10, and the T1 to T4 control means 3F to 3I controls four feed units 12 that will be described later.

Next, the transfer feeder 10 will be explained. The transfer feeder 10 successively transfers the work 11 worked in each of the working stations W1 to W4 to the downstream side in transfer areas T1 to T4 which are set along the adjacent working stations W1 to W4 and set at the downstream side of the final working station (W4 in this case). Accordingly, the transfer feeder 10 is constituted by four of the feed units 12 each disposed inside the transfer areas T1 to T4 as shown in FIG. 2 and FIG. 3.

Each of the feed units 12 includes the following components. Namely, first of all, it includes a pair of left and right lift beams 13 and 13 (corresponding to conventional transfer bars) movable up and down, which are disposed in parallel along the work transfer direction and spaced in a horizontal direction so as not to interfere with the slide motion. At upper portions of a pair of the left and right lift beams 13 and 13, provided are lift drive means having lift shaft servo motors 14 and 14 for driving the lift beams 13 and 13 up and down. By outputting a control signal to the aforementioned lift drive means from corresponding one of the T1 to T4 control means 3F to 3I, the lift beam 13 is driven to move up and down. At lower portions of the lift beams 13 and 13, provided are carriers 15 and 15 to be movable in a longitudinal direction of the lift beam 13. At an upper portion of each of the carriers 15 and 15, included is carrier drive means having linear motors 16 and 16 (see FIG. 6) for driving each of the carriers 15 in the longitudinal direction of the lift beam 13. Carrier movement is controlled by outputting a control signal to the aforementioned carrier drive means from corresponding one of the T1 to T4 control means 3F to 3I.

Further, sub-carriers 50 and 50 (details will be described later) are provided at a lower portion of the respective carriers 15 and 15 to be movable in the longitudinal direction of the lift beam 13. Power transmission means for transmitting driving force of the carrier 15 to the sub-carrier 50 is provided between the carrier 15 and the sub-carrier 50 at the lower portion thereof. A cross bar 17 is spanned between the sub-carriers 50 and 50 provided at a pair of the left and right carriers 15 and 15 opposing each other. The cross bar 17 is provided with a vacuum cup device 18 capable of sucking, for example, the work 11 at a predetermined number of spots (four spots in this embodiment) as the work holding means. A control signal is inputted into the vacuum cup device 18 of each of the cross bars 17 from corresponding one of the T1 to T4 control means 3F to 3I, whereby the operation of suction is controlled.

Figure 5:
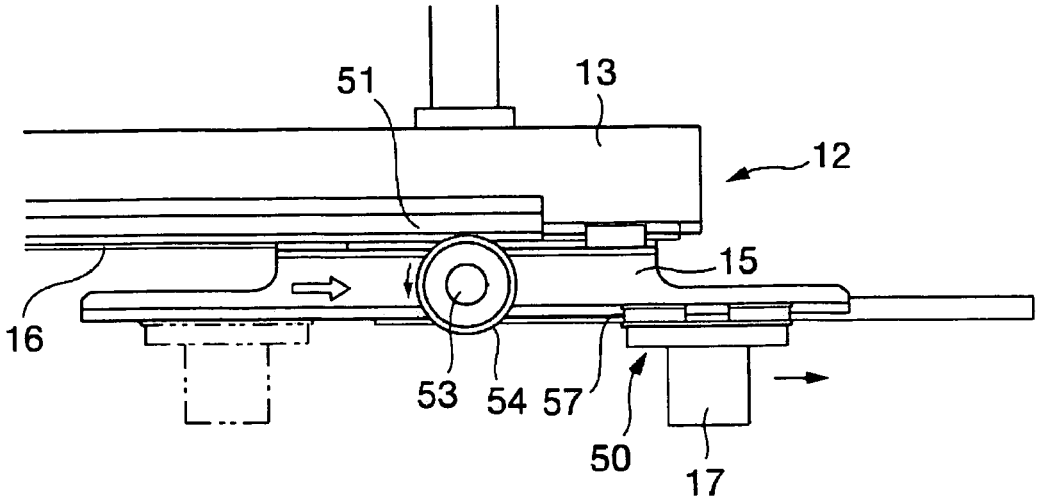
FIG. 5 is a front view of sub-carrier moving means according to a first embodiment of the present invention.

Next, sub-carrier moving means of the work transfer apparatus according to the first embodiment will be explained in detail based on FIG. 5 and FIG. 6. FIG. 5 is a front view of the sub-carrier moving means of this embodiment, and FIG. 6 is a right side view of FIG. 5.

Figure 6:
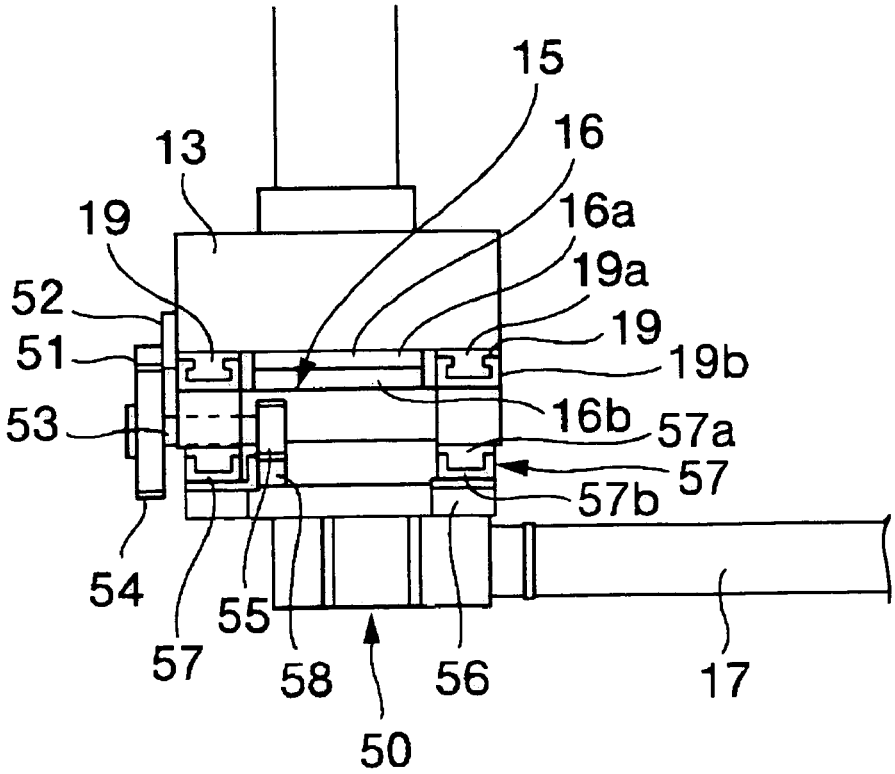
FIG. 6 is a right side view of FIG. 5.

As shown in FIG. 5 and FIG. 6, the linear motor 16 is placed along the work transfer direction between the lift beam 13 and the carrier 15, and linear guides 19 and 19 are placed along the work transfer direction at both sides of the linear motor 16. A guide rail 19*a* of each of the linear guides 19 is attached at a bottom surface of the lift beam 13 and a guide member 19*b* of the linear guide 19 is attached at a top surface of the carrier 15. The guide member 19*b* is slidably engaged with the guide rail 19*a* in a state in which it is suspended from the guide rail 19*a*. Each of the linear motors 16 enables each of the carriers 15 to be self-propelled independently along the linear guides 19. Any one of a primary coil 16*a*, and a secondary conductor 16*b* or a secondary permanent magnet, which constitute the linear motor 16, is laid on the lift beam 13 side and the other one is laid on the carrier 15 side to oppose the aforementioned one of them. The carrier 15 can be made to travel at an optional speed along the linear guides 19 by inputting a control signal into the primary coil 16*a* from the corresponding one of the T1 to T4 control means 3F to 3I.

As shown in FIG. 6, a transverse section in the longitudinal direction of the lift beam 13 is substantially a rectangular shape, and a rack 51 is attached along a laterally outer surface of the lift beam 13 by means of a bonding member 52. A tooth portion of the rack 51 is provided to be substantially parallel with the bottom surface of the lift beam 13. Meanwhile, as shown in FIG. 5, a pinion shaft 53 is rotatably supported at substantially a center part of the carrier 15 with its shaft axis orthogonal to the moving direction of the carrier 15. A first pinion 54 is attached to one end portion of the pinion shaft 53, and it is provided so that the first pinion 54 and the rack 51 are meshed with each other. Further, a second pinion 55 is attached to the other end portion of the pinion shaft 53.

A frame 56 of the sub-carrier 50 is placed under the carrier 15. Linear guides 57 and 57 are provided at both sides along the longitudinal direction at the lift beam 13 at the bottom surface of the carrier 15. A guide rail 57*a* of the linear guide 57 is attached to the bottom surface of the carrier 15, and a guide member 57*b* of the linear guide 57 is attached to a top surface of the frame 56. The guide member 57*b* is slidably engaged with the guide rail 57*a* in a state in which it is suspended from the guide rail 57*a*. The sub-carrier 50 is moved by being guided by the linear guide 57. A rack 58 is attached to the top surface of the frame 56 in parallel with the linear guide 57 so as to be meshed with the second pinion 55.

Next, an operation of the sub-carrier moving means of the above-described constitution will be explained. When the carrier 15 is driven by the linear motor 16, the carrier 15 is moved in the longitudinal direction of the lift beam 13. At the same time, the pinion shaft 53 is also moved in the same direction as the carrier 15, and by this movement, the first pinion 54 is meshed with the rack 51 to follow its motion to rotate, thus rotating the second pinion 55 at the same time via the pinion shaft 53. When the second pinion 55 is rotated, with this rotation as a driving source, the sub-carrier 50 including the rack 58 meshed with the second pinion 55 is driven. Accordingly, the sub-carrier 50 moves longer distance than the moving distance of the carrier 15 to the moving direction of the carrier 15. Namely, the sub-carrier 50 is moved to a position offset from the moved position of the carrier 15.

Figure 7:
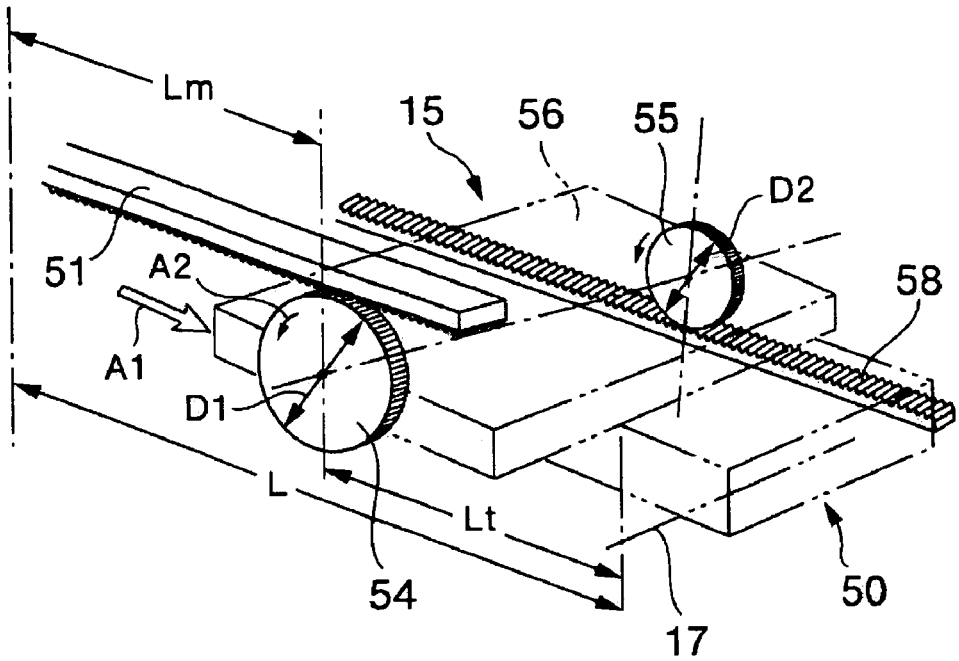
FIG. 7 is an explanatory view of moving distances of a carrier and a sub-carrier of the first embodiment.

Here, based on FIG. 7, the moving distances of the carrier 15 and the sub-carrier 50 will be explained. In FIG. 7, when the carrier 15 is moved in a direction of the arrow A1 by the linear motor 16, the first pinion 54 is rotated in a direction of the arrow A2. Here, the present position before the carrier 15 is moved is set as a reference point. When a moving distance by which the carrier 15 moves to the upstream side or the downstream side from this reference point is assumed to be Lm, rotational frequency N of the first pinion 54 by the movement of the carrier 15 is $N=Lm/(\pi \times D1)$. Here, it is assumed that D1 is a diameter of a pitch circle of the first pinion 54, and that the dimensions of the modules of the first pinion 54 and the second pinion 55 are the same. When a distance by which the rack 58 and the sub-carrier 50 move in the direction of the arrow A1 with respect to the carrier 15 as a result of the second pinion 55 makes N rotations similarly to the first pinion 54 is assumed to be Lt, $Lt=N\times \pi \times D2=Lm\times(D2/D1)$. Here, D2 is a diameter of the pitch circle of the second pinion 55.

Accordingly, a total moving distance L of the sub-carrier 50 at which the rack 58 is attached before it is moved is found by adding up the moving distance Lm of the carrier 15 from the reference point to a movement completion position and the moving distance Lt of the sub-carrier 50 with respect to the carrier to be $L=Lm+Lt$. Namely, the moving distance Lt is an offset amount of the sub-carrier 50 with respect to the carrier 15, and is obtained from the moving distance Lm of the carrier 15 based on a diameter ratio of the pitch circles of the first pinion 54 and the second pinion 55 (D2/D1), namely, the power transmission attenuation ratio such as a gear ratio.

Next, with reference to FIG. 2 and FIG. 3, a transfer method of the work 11 by the transfer feeder 10 of the above constitution will be explained. First, when working in the working station W1 is finished and the slide 5 starts to rise in the transfer area T1, the carrier 15 of the lift beam 13 at a position of predetermined height is moved toward an end portion of the working station W1 side along the lift beam 13. Following the movement of the carrier 15, the sub-carrier 50 is moved to a position past the moved position of the carrier 15 by a predetermined offset amount Lt corresponding to the moving distance Lm of the carrier 15 in the same moving direction as the carrier 15 (see the carrier 50A and the cross bar 17A shown by the chain double-dashed line in FIG. 2 and FIG. 3). As a result, the vacuum cup device 18 is positioned at a work suction position in the working station W1. Next, at this position, the lift beam 13 is lowered to suck the work 11.

Thereafter, the lift beam 13 is raised, and the carrier 15 is moved to the downstream side, namely, an end portion at the side of the working station W2, whereby the sub-carrier 50 is similarly moved in the downstream direction. Then the sub-carrier 50 is moved to a position offset to the working station W2 by a predetermined distance from the moved position of the carrier 15 (see the sub-carrier 50B and the cross bar 17B shown by the chain double-dashed line in FIG. 2 and FIG. 3). Thereby, the vacuum cup device 18 is positioned at the work suction position of the working station W2. Subsequently, the lift beam 13 is lowered at this position and the work 11 is released. Next, before the slide 5 of the working station W2 is not completely lowered, namely, before press working starts in the working station W2, the lift beam 13 is raised. Namely, the carrier 15 is returned to substantially the central position of the transfer area T1 so that the sub-carrier 50 and the cross bar 17 do not interfere with the slide 5 and the die.

Subsequently, when working in the working station W2 is finished, the sub-carrier 50 is driven by the movement of the lift beam 13 and the carrier 15 in the transfer area T2 as the feed unit 12 of the transfer area T1. The respective feed units 12 are similarly driven in the transfer areas T3 and T4, whereby the work is carried in and out in all the transfer areas T1 to T4, and it is finally transferred to a transfer apparatus or the like not shown from the transfer area T4. Actually, the carrier 15 and the sub-carrier 50 are not moved in a state in which the lift beam 13 is standing still, but they are moved while the lift beam 13 is moved up and down. As a result, efficient transfer with simultaneous drive of the driving shaft can be performed, and working speed (operation strokes per minute) can be enhanced.

As explained above, the following effects are provided according to the first embodiment.

(1) In the transfer press having a plurality of working stations, a pair of lift beams 13 and 13 corresponding to each area between the adjacent working stations are provided in parallel along the work transfer direction to be movable up and down. The respective lift beams 13 and 13 are provided with the carriers 15 and 15 driven along the longitudinal direction by the predetermined drive means. Further, the carriers 15 and 15 are provided with the sub-carriers 50 and 50 to be movable in the longitudinal direction of the lift beam 13. In addition, the driving force of the sub-carriers 50 and 50 are obtained by the power transmission mechanism utilizing the movement of the carriers 15 and 15, and the cross bar 17 provided with the work holding means such as the vacuum cup device 18 is spanned between a pair of opposing sub-carriers 50 and 50. In this constitution, by adjusting the moving distance Lm of the carriers 15 and 15 corresponding to each area between the working stations, a feed stroke L of the sub-carriers 50 and 50 and the cross bar 17 can be adjusted for each area between the working stations. As a result, work transfer can be also performed with reliability in the transfer press in which the transfer pitches between the adjacent working stations are different. Accordingly, as compared with the prior art in which all the transfer pitches are designed to conform to the maximum transfer pitch, the length of the transfer press line can be designed to be optimally short. Even with the transfer press in which the uprights exist between the working stations, the work can be directly transferred to the next working station without providing idle stations at the part of the uprights, and therefore the entire transfer press line including all the working stations can be reduced.

(2) The rising and lowering stroke of the lift beam 13 and the feed stroke of the cross bar can be adjusted for each working station, and therefore timing of the feed motion of the work holding means can be adjusted for each of the working stations. Accordingly, a die interference curve corresponding to the attached die can be set. Further, the origin position (feed level) for each working station can be set at the position corresponding to the dies. Accordingly, the interference curve corresponding to a die can be set for each process, and optimal die design can be made.

(3) The sub-carrier 50 made movable along the carrier 15 is moved to the position offset from the center part of the lift beam 13 toward the end portion from the moved position of the carrier 15. Therefore, as shown in FIG. 5, the work holding means of the cross bar 17 can be moved past the both end portions of the lift beam 13 to the position overlapping the adjacent lift beam 13. Consequently, even with the constitution in which the conventional one transfer bar is divided and a plurality of lift beams 13 are arranged substantially in line in the work transfer direction, the constraint of the work transfer distance by this is eliminated, and the degree of freedom in setting the feed motion of the work holding, means can be increased.

(4) Since the carrier driving force is transmitted to the sub-carrier 50 by utilizing the power occurring when the carrier 15 is moved, the drive source for the sub-carrier 50 is not needed, and the constitution can be made compact. Since the rack and the pinion are used as the power transmission means for transmitting the driving force of the carrier 15 to the sub-carrier 50, it can be transmitted with reliability, and the constitution of the carrier 15 and the sub-carrier 50 is simple, and can be made compact.

(5) Since the linear motor 16 is used as the drive means for moving the carrier 15, the drive source can be reduced in weight and size, and has a structure resistant to vibrations.

Figure 8:
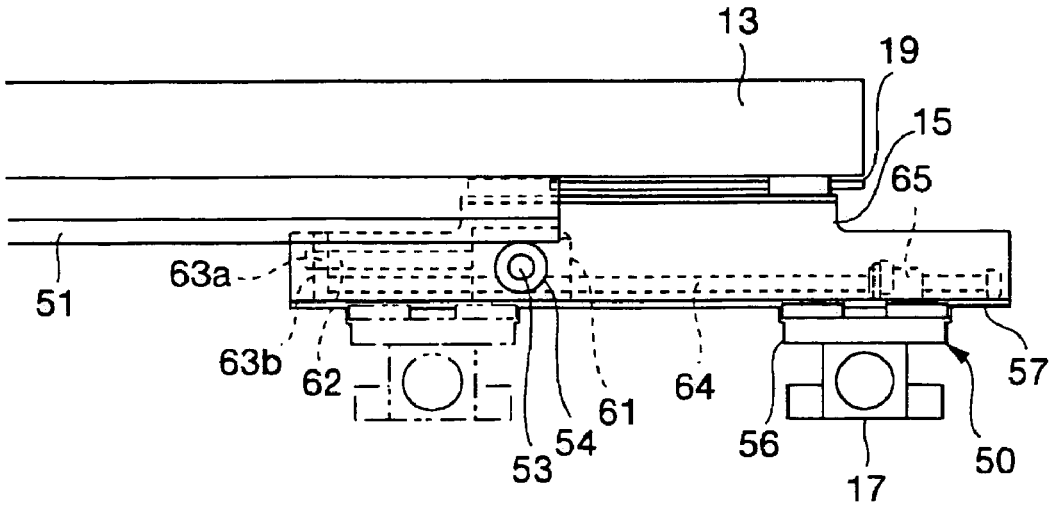
FIG. 8 is a front view of an essential part of a sub-carrier according to a second embodiment of the present invention.

Next, sub-carrier moving means according to a second embodiment will be explained based on FIG. 8 to FIG. 10. FIG. 8 is a front view of an essential part of the sub-carrier moving means, and FIG. 9 is a right side view of FIG. 8.

Figure 9:
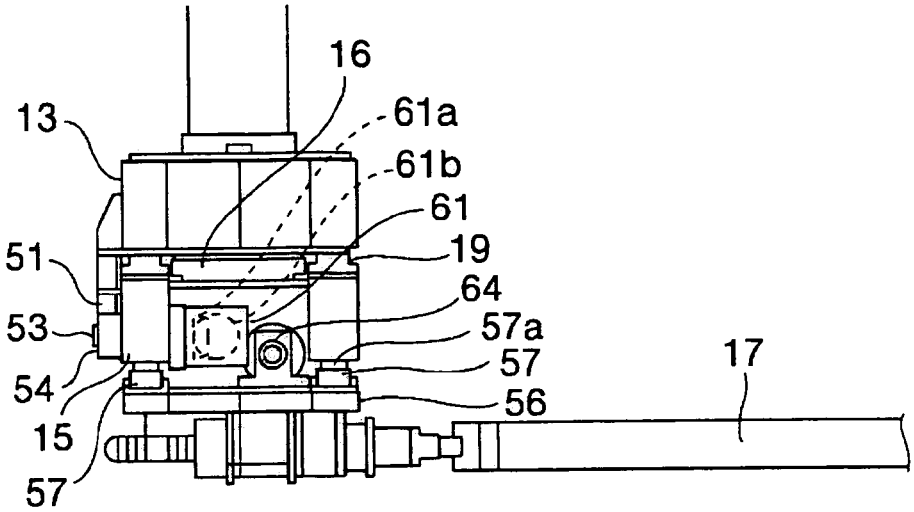
FIG. 9 is a right side view of FIG. 8.
Figure 10:
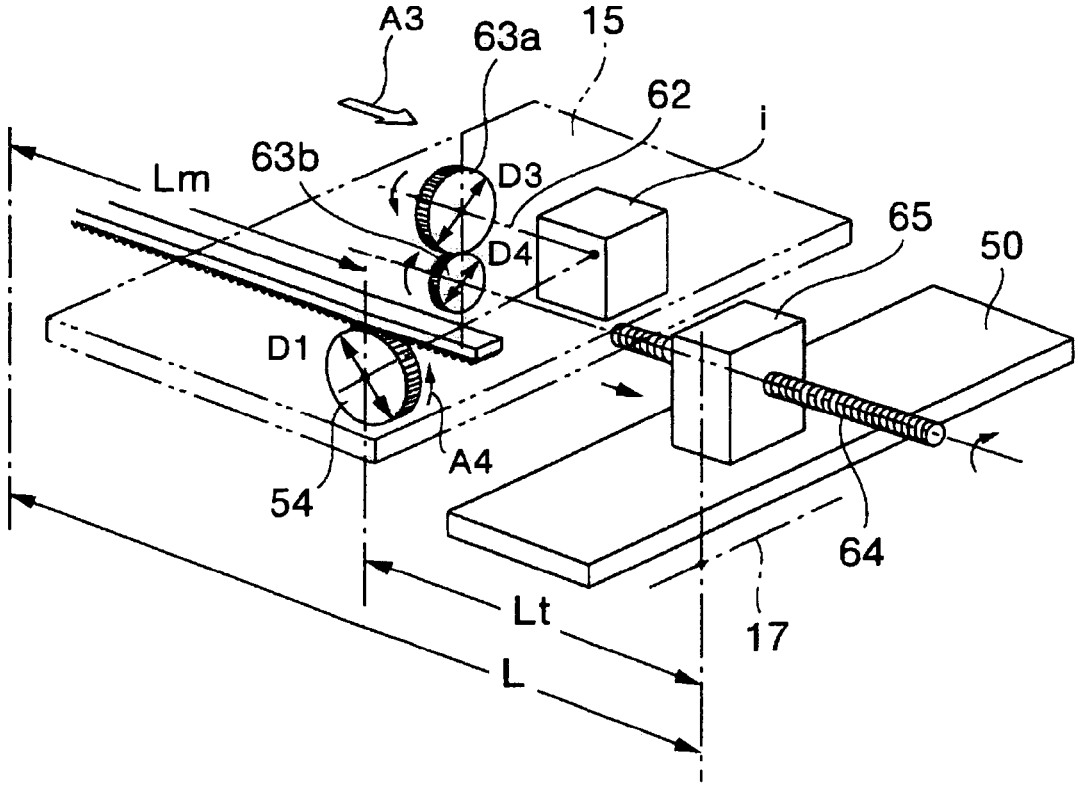
FIG. 10 is an explanatory view of moving distances of a carrier and the sub-carrier of the second embodiment.

In FIG. 8 and FIG. 9, the linear motor 16 is attached between the lift beam 13 and the carrier 15, the carrier 15 is moved along the longitudinal direction of the lift beam 13 with the linear motor 16 as a driving source, and the linear guide 19 as a guide. The first pinion 54 is attached to one end portion of the pinion shaft 53 rotatably provided at the carrier 15, and the first pinion 54 and the rack 51 provided at the lift beam 13 are meshed with each other. The frame 56 of the sub-carrier 50 is placed under the carrier 15. The linear guides 57 and 57 are placed at both sides along the longitudinal direction at the lift beam 13 at the bottom surface of the carrier 15 so that the sub-carrier 50 can be independently moved by being guided by the linear guides 57 and 57.

Further, an input side bevel gear 61*a* is attached to the other end portion, and an output side bevel gear 61*b* meshed with the bevel gear 61*a* is attached to one end portion of a shaft 62. The shaft 62 is rotatably supported at a bevel gear box 61 in which a pair of bevel gears 61*a* and 61*b* are equipped. The bevel gear box 61 is attached at the carrier 15. The shaft 62 is placed along the longitudinal direction of the lift beam 13, and a gear 63*a* is attached to the other end portion of the shaft 62. A nut 65 is attached at the top surface of the frame 56 of the sub-carrier 50, and a shaft 64 (ball screw or the like) having a male thread on its outer circumference provided along the longitudinal direction of the lift beam 13 is screwed into the nut 65. A second pinion 63*b* meshed with the gear 63*a* is attached to an end portion of the shaft 64 at the opposite side of the nut 65. The region of the shaft 64 near the second pinion 63 is rotatably supported by the carrier 15.

An operation of the sub-carrier moving means of this embodiment is as follows. When the carrier 15 is driven by the linear motor 16, the pinion shaft 53 is moved with the carrier 15, and the first pinion 54 is meshed with the rack 51 to follow its movement to rotate. As a result, the input side bevel gear 61*a* is simultaneously rotated via the pinion shaft 53, and the gear 63*a* is rotated via the output side bevel gear 61*b* meshed with the bevel gear 61*a*. When the gear 63*a* is rotated, with this rotation as a driving source, the shaft 64 is rotated via the second pinion 63*b*, whereby the sub-carrier 50, at which the nut 65 screwed into the shaft 64 is attached, is moved along the longitudinal direction of the lift beam 13. Accordingly, the sub-carrier 50 is moved to the position offset from the moved position of the carrier 15.

Here, the moving distances of the carrier 15 and the sub-carrier 50 will be explained with reference to FIG. 10. In FIG. 10, when the carrier 15 is moved in the direction of the arrow A3 by the linear motor 16, the first pinion 54 is rotated in the direction of the arrow A4. Here, the present position before the carrier 15 moves is assumed to be a reference point. When the moving distance by which the carrier 15 moves from the reference point to the upstream side or the downstream side is assumed to be Lm, the rotational frequency N1 of the first pinion 54 by the movement of the carrier 15 is $N1=Lm/(\pi \times D1)$. Here, D1 is the diameter of the pitch circle of the first pinion 54.

When the distance by which the sub-carrier 50 is moved in the direction of the arrow A3 that is the same direction as the carrier 15 with the movement of the carrier 15 as a driving source is assumed to be Lt, $Lt=Ns \times Ls=[Lm/(\pi \times D1)] \times i \times [D3/D4] \times Ls$. Here, i represents the rotational frequency ratio of the bevel gears 61*a* and 61*b*, Ls represents a lead of the male thread of the shaft 64, D3 and D4 represent the diameters of the pitch circles of the gear 63*a* and the second pinion 63*b*, and the dimensions of the modules of the gear 63 and the pinion are assumed to be the same.

Accordingly, the total moving distance L from the time before the sub-carrier 50 moves is $L=Lm+Lt$. Namely, the moving distance Lt is an offset amount of the sub-carrier 50 with respect to the carrier 15, and can be obtained from the moving distance Lm of the carrier 15 based on the power transmission ratio from the carrier 15 to the sub-carrier 50 such as the pitch circle diameter D1 of the first pinion 54, the rotational frequency ratio i of the bevel gears 61*a* and 61*b*, the diameter ratio (D3/D4) of the pitch circles of the gear 63*a* and the second pinion 63*b*, namely, the gear ratio, and the lead Ls of the male thread of the shaft 64. The moving distance of the carrier 15 can be controlled by controlling the moving amount of the linear motor 16 driving along the lift beam.

The effects according to the second embodiment will be explained. In the second embodiment, the power transmission means for transmitting the driving force of the carrier 15 to the sub-carrier 50 is constituted by the rack 51 and the pinion 54, the bevel gears 61*a* and 61*b*, the shaft 64 having the male thread on its outer circumference, the nut 65 and the like. As a result, power transmission can be carried out with reliability, and the power transmission means can be made compact with a simple structure. The other effects are the same as the first embodiment, and the explanation thereof will be omitted.

Figure 11:
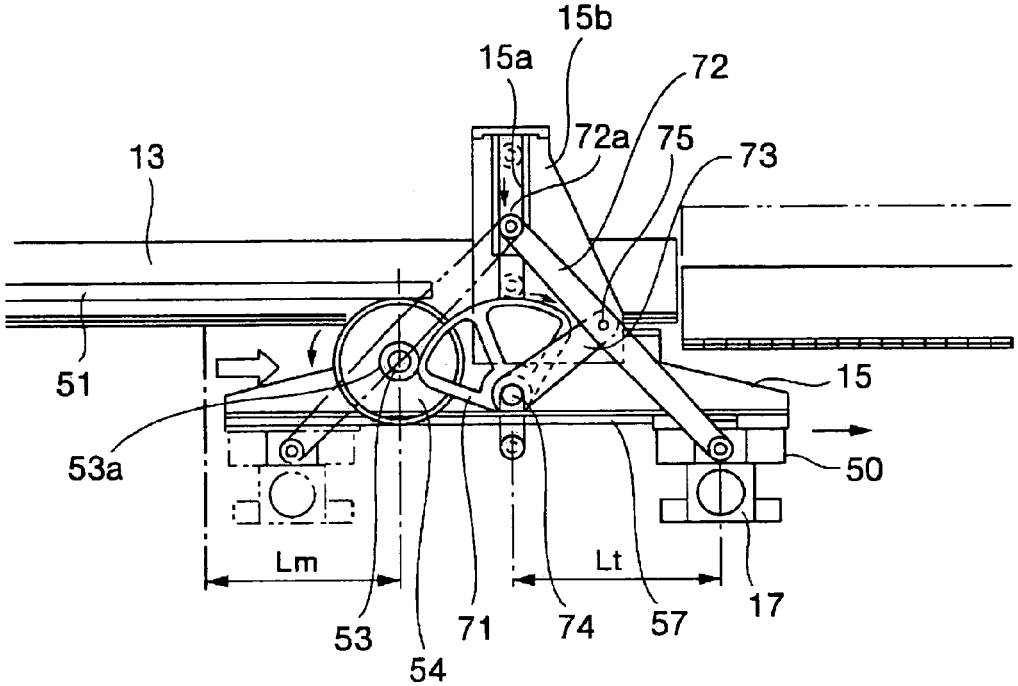
FIG. 11 is a front view of an essential part of sub-carrier moving means according to a third embodiment of the present invention.

Next, sub-carrier moving means according to a third embodiment will be explained based on FIG. 11 to FIG. 13. FIG. 11 is a front view of an essential part, and FIG. 12 is a right side view of FIG. 11.

Figure 12:
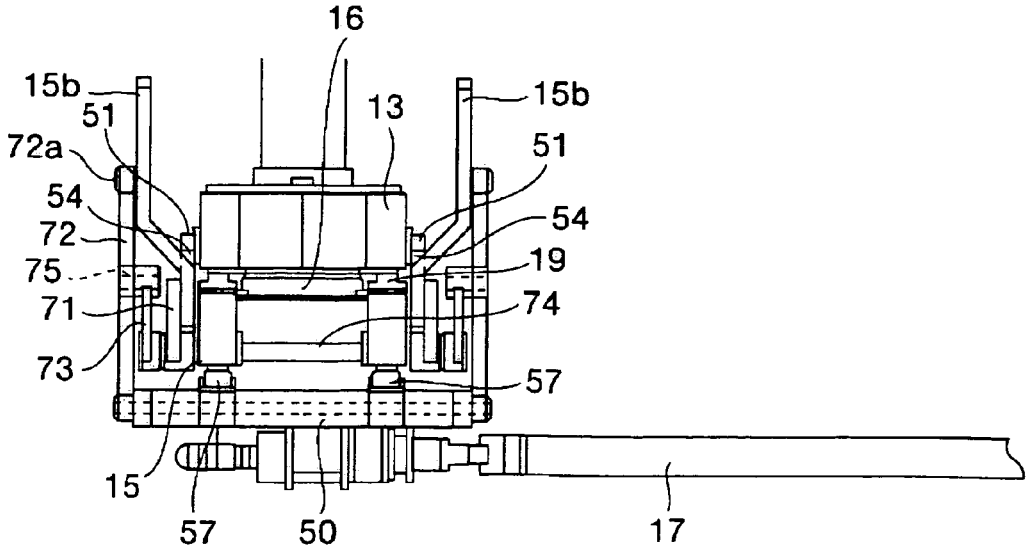
FIG. 12 is a right side view of FIG. 11.
Figure 13:
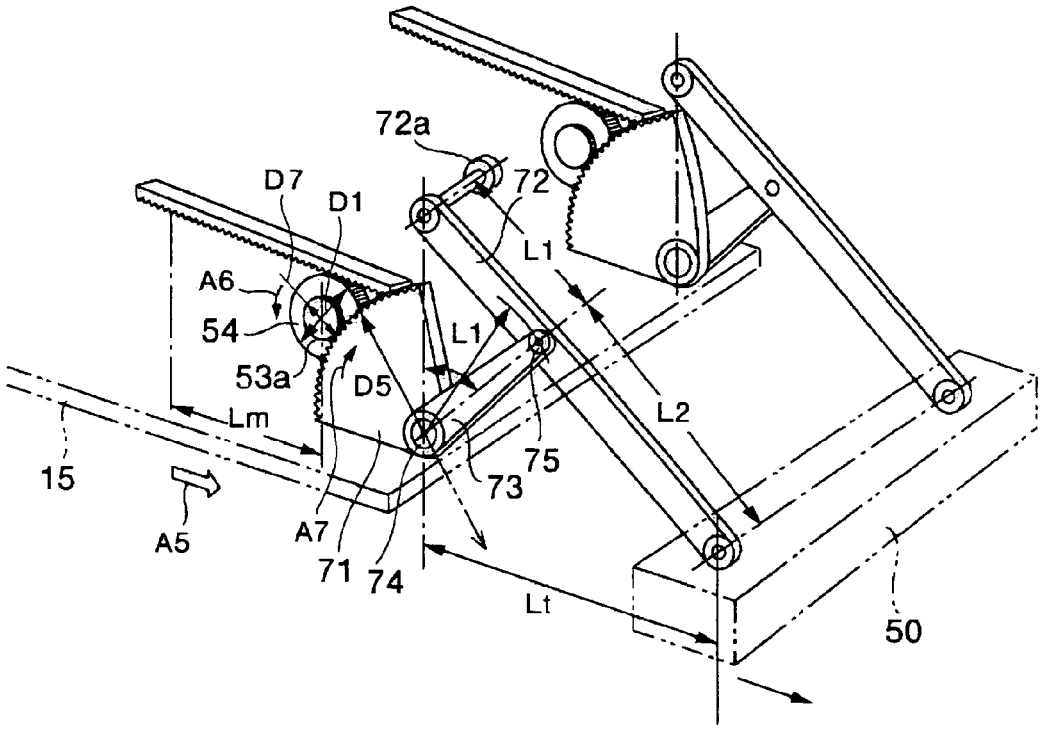
FIG. 13 is an explanatory view of moving distances of a carrier and a sub-carrier of the third embodiment.

In FIG. 11 and FIG. 12, the linear motor 16 is attached between the lift beam 13 and the carrier 15, and with the linear motor 16 as a driving source, and the linear guide 19 as a guide, the carrier 15 is moved along the longitudinal direction of the lift beam 13. The constitution of the sub-carrier moving means at both side surface portions of the carrier 15 are the same, and therefore the constitution at only one side will be explained hereinafter. The pinion shaft 53 is rotatably provided at the side surface of the carrier 15, and the pinion 54 is attached at an outer side end portion of the pinion shaft 53. A deformation gear 71 having gear teeth on its sector circumference portion is attached to the carrier 15 with a shaft 74 provided at a center part of a sector arc thereof being rotatably supported at the carrier 15. The gear at the outer circumference portion of the deformation gear 71 is meshed with an idle gear 53*a* attached at the pinion shaft 53.

Brackets 15*b* protruding upward are attached at top portions of substantially a center of both side surfaces of the carrier 15, and a grooves 15*a* each in a concave shape extending in substantially a vertical direction are formed on outer side surfaces of the brackets 15*b*. A roller 72*a* rotatably provided at one end of a lever 72 is rollably inserted in the groove 15*a* in a concave shape with both side surfaces of the groove 15*a* as rolling contact surfaces, and the other end portion of the lever 72 is rotatably connected to the sub-carrier 50 with a pin.

One end portion of a lever 73 is fixed to a rotation center shaft 74 of the deformation gear 71, and the other end portion of the lever 73 is rotatably connected to a middle portion between both end axes of the lever 72 with a shaft 75. A distance between both shafts 74 and 75 of the lever 73 and a distance between the shaft 75 and a rotation axis of the roller 72*a* at the lever 72 are constituted to be equal. The frame 56 of the sub-carrier 50 is placed under the carrier 15. The linear guides 57 and 57 are placed at both sides of the bottom surface of the carrier 15 along the longitudinal direction of the lift beam 13 so that the sub-carrier 50 can be independently self-propelled by being guided by the linear guides 57 and 57.

Next, an operation of the sub-carrier moving means of the third embodiment will be explained. When the carrier 15 is driven by the linear motor 16, the pinion shaft 53 is moved with the carrier 15, and the pinion 54 is meshed with the rack 51 to follow its movement to rotate. As a result, the deformation gear 71 meshed with the idle gear 53*a* attached to the pinion shaft 53 is simultaneously rotated, and the lever 73 attached at the rotation center shaft 74 is rotated. By the rotation of the lever 73, the shaft 75 is moved in the same moving direction as the carrier 15 to move the lever 72, and therefore the roller 72*a* rolls inside the groove 15*a* to move up and down. Then, the sub-carrier 50 is moved in the same moving direction as the carrier 15 by being guided by the linear guides 57 and 57. Accordingly, the sub-carrier 50 is moved to a position offset from the moved position of the carrier 15.

Here, the moving distances of the carrier 15 and the sub-carrier 50 will be explained with reference to FIG. 13. When the carrier 15 is moved in the direction of the arrow A5 by the linear motor 16, the pinion 54 is rotated in the direction of the arrow A6, and the deformation gear 71 is rotated in the direction of the arrow A7. The lever 73 is also rotated integrally with the rotation of the deformation gear 71 with the shaft 74 as a center, and the roller 72*a* of the lever 72 rolls downward inside the concave-shaped groove 15*a*. The sub-carrier 50 at the other end portion of the lever 72 and the cross bar 17 are guided by the linear guide 57 to be moved in the same direction as the arrow A5.

Now, the distance between both the shafts 74 and 75 of the lever 73 and the distance between the shaft 75 and the rotation axis of the roller 72*a* are equally set to be L1, and the distance between the shaft 75 at the lever 72 and a connecting axis of the lever 72 with the carrier 50 is set to be L2. In each of the transfer areas T1 to T4, the middle position in a movable range of the carrier 15 is set to be a reference point, and at the position of this reference point, both the lever 72 and the lever 73 are assumed to be upright in the vertical direction seen from the front in FIG. 11. A moving distance by which the carrier 15 moves from the reference point to the upstream side or the downstream side is set to be Lm, the diameter of the pitch circle of the pinion 54 is D1, the diameter of the pitch circle of the idle gear 53*a* is D7, and the diameter of the pitch circle of the deformation gear 71 is D5.

When the carrier 15 moves by the distance Lm from the reference point, the distance Lt by which the sub-carrier 50 moves is found from $Lt=(L1+L2)\times\sin[2\times D7\times Lm/(D1\times D5)]$ from the mechanical relationship. Accordingly, the moving distance L of the sub-carrier 50 at this time is $L=Lm+Lt$. Namely, the moving distance Lt is an offset amount of the sub-carrier 50 with respect to the carrier 15, and it is obtained from the moving distance Lm of the carrier 15 based on the mechanical parameter from the carrier 15 to the sub-carrier 50 as described above. It is the same as the above description that the moving distance of the carrier 15 can be controlled by controlling the moving amount of the linear motor 16 driving along the lift beam.

The effects according to the third embodiment will be explained. In the third embodiment, the power transmission means for transmitting the driving force of the carrier 15 to the sub-carrier 50 is constituted by the rack 51 and the pinion 54, the deformation gear 71, the lever 73 with the moving direction of its end portion being restricted to be the vertical direction and the moving direction of the sub-carrier 50, the lever 72 attached to the rotation shaft 74 of the deformation gear 71, and the like, and therefore power transmission can be carried out with reliability. Since the other effects are the same as in the first embodiment, the explanation is omitted here.

Next, sub-carrier moving means according to a fourth embodiment will be explained based on FIG. 14 and FIG.

15. FIG. 14 is a front view of an essential part, and FIG. 15 is a right side view of FIG. 14.

Figure 14:
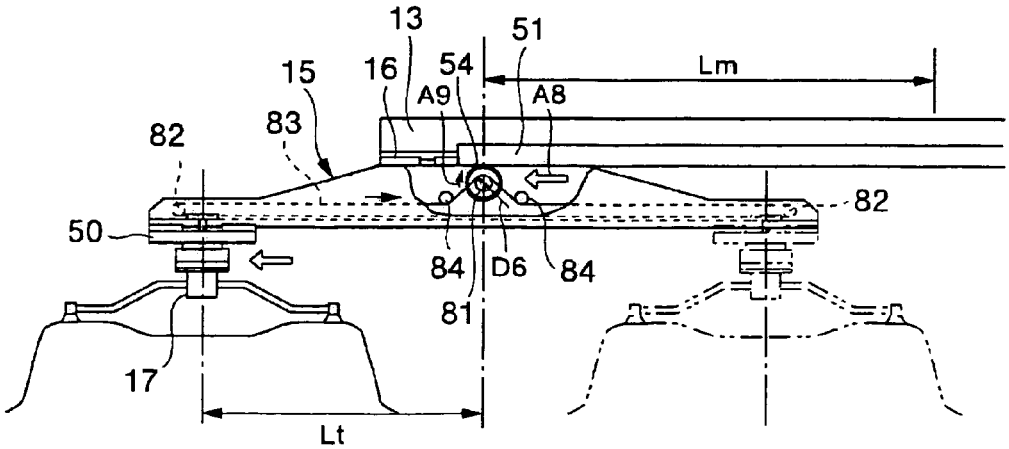
FIG. 14 is a front view of an essential part of sub-carrier moving means according to a fourth embodiment of the present invention.
Figure 15:
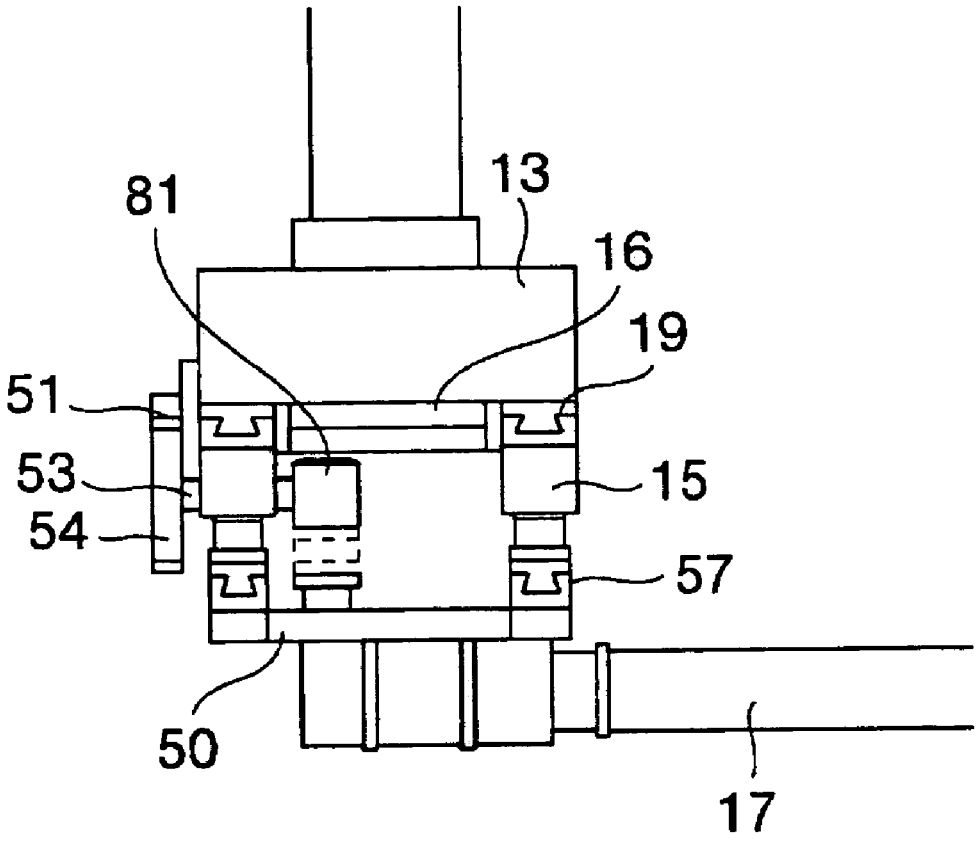
FIG. 15 is a right side view of FIG. 14.

In FIG. 14 and FIG. 15, the pinion shaft 53 is rotatably provided at substantially a center part of the side surface of the carrier 15, and the pinion 54 is attached at an outer side end portion of the pinion shaft 53. A pulley 81 is attached at the other end portion of the pinion shaft 53. Pulleys 82 and 82 are rotatably provided at both front and rear end portions of the carrier 15 in the longitudinal direction of the lift beam 13 (namely, the work transfer direction), and an endless belt 83 such as a timing belt is wound around the pulley 81 and pulleys 82 and 82. A sub-carrier 50 is attached to a lower belt of the endless belt 83 between the front and rear pulleys 82 and 82. An upper belt of the endless belt 83 is wound around the pulley 81, and predetermined tension is given to the endless belt 83 with tension pulleys 84 and 84 provided in the vicinity of the areas in front and behind the pulley 81.

An operation according to the above constitution will be explained. When the carrier 15 is moved by the linear motor 16, the pinion 54 is meshed with the rack 51 to be rotated, and the pulley 81 at the same shaft is rotated, thus rotating the endless belt 83. By the rotation of the endless belt 83, the sub-carrier 50 is moved along the longitudinal direction of the lift beam 13 with the linear guide 57 as a guide. As shown in FIG. 14, when the carrier 15 is moved in the direction of the arrow A8, the pinion 54 and the pulley 81 at the same shaft as this are rotated in the direction of the arrow A9, and therefore the endless belt 83 moves the sub-carrier 50 in the direction of the arrow A8 which is in the same direction as the carrier 15. Accordingly, the sub-carrier 50 is moved to the position offset from the moved position of the carrier 15.

The moving distances of the carrier 15 and the sub-carrier 50 will be explained based on FIG. 14. In the transfer areas T1 to T4, the position, in which the position of the pinion 54 of the carrier 15 and the attachment position of the sub-carrier 50 to the endless belt 83 are equal in the transfer direction, is assumed to be a reference point. If the moving distance from the reference point (work transfer distance) is made equal in the longitudinal direction, the reference point is the middle position in the movable range of the carrier 15. When the moving distance by which the carrier 15 moves from this reference point to the upstream or the downstream side is assumed to be Lm, the rotational frequency N of the pinion 54 by the movement of the carrier 15 is $N=Lm/(\pi\times D1)$. Here, D1 represents a diameter of the pitch circle of the pinion 54.

When the pinion 54 makes N rotations, the pulley 81 also makes N rotations, and therefore if the distance, by which the endless belt 83 and the sub-carrier 50 are moved in the direction of the arrow A8 by the N rotations of the pulley 81, is assumed to be Lt, $Lt=N\times\pi\times D6=Lm\times D6/D1$. Here, D6 represents a diameter of an outer circumference surface of the pulley 81. Thus, by selecting the diameter ratio of the pitch circle of the pinion 54 and the outer circumference surface of the pulley 81, the moving distance Lt of the sub-carrier 50 can be set. The total moving distance L of the sub-carrier 50 from the reference point is $L=Lm+Lt$, and the moving distance Lt is an offset amount of the sub-carrier 50 with respect to the carrier 15, which is obtained from the moving distance Lm of the carrier 15.

The effects of the fourth embodiment will be explained. In the fourth embodiment, the power transmission means for transmitting the driving force of the carrier 15 to the sub-carrier 50 is constituted by the rack 51 and the pinion 54, the pulleys 81, 82, and 84, the endless belt 83 and the like, and therefore power transmission can be carried out with reliability, thus making it compact with the simple constitution. The other effects are the same as in the first embodiment, and therefore the explanation here is omitted.

Figure 16:
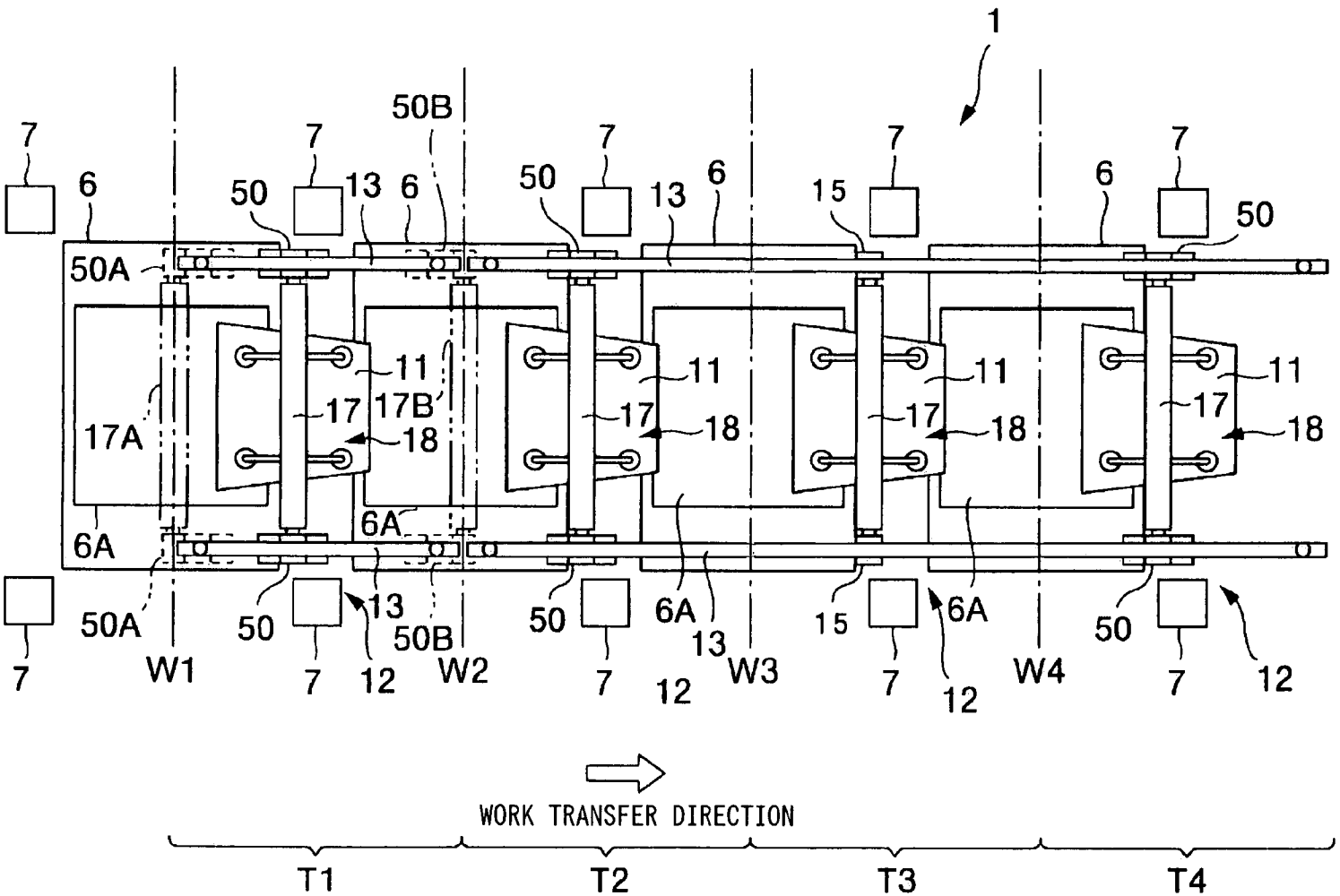
FIG. 16 is a sectional plan view of a transfer press according to a fifth embodiment of the present invention.
Figure 17:
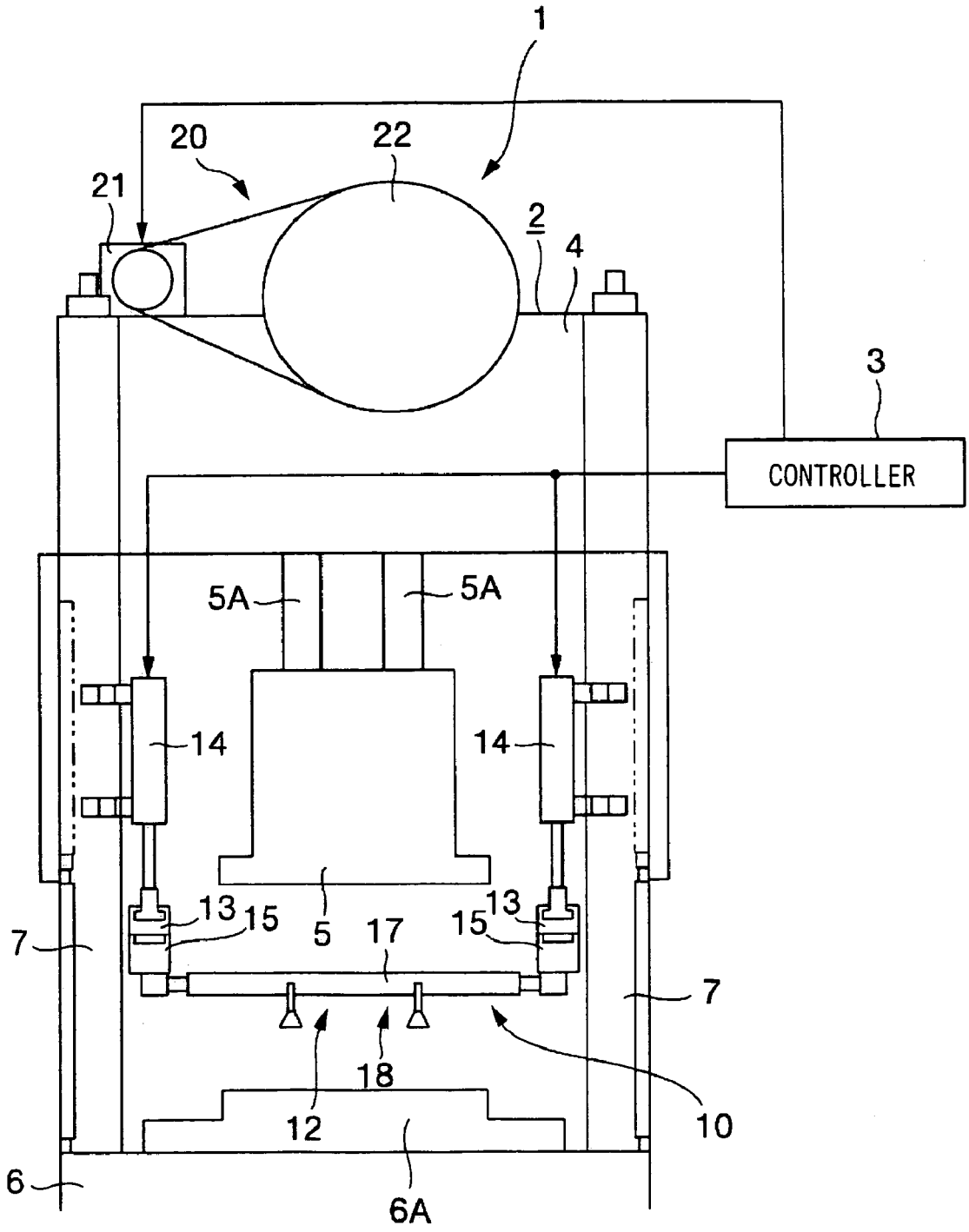
FIG. 17 is a side view of the transfer press showing carriers for T3 of the fifth embodiment.
Figure 18:
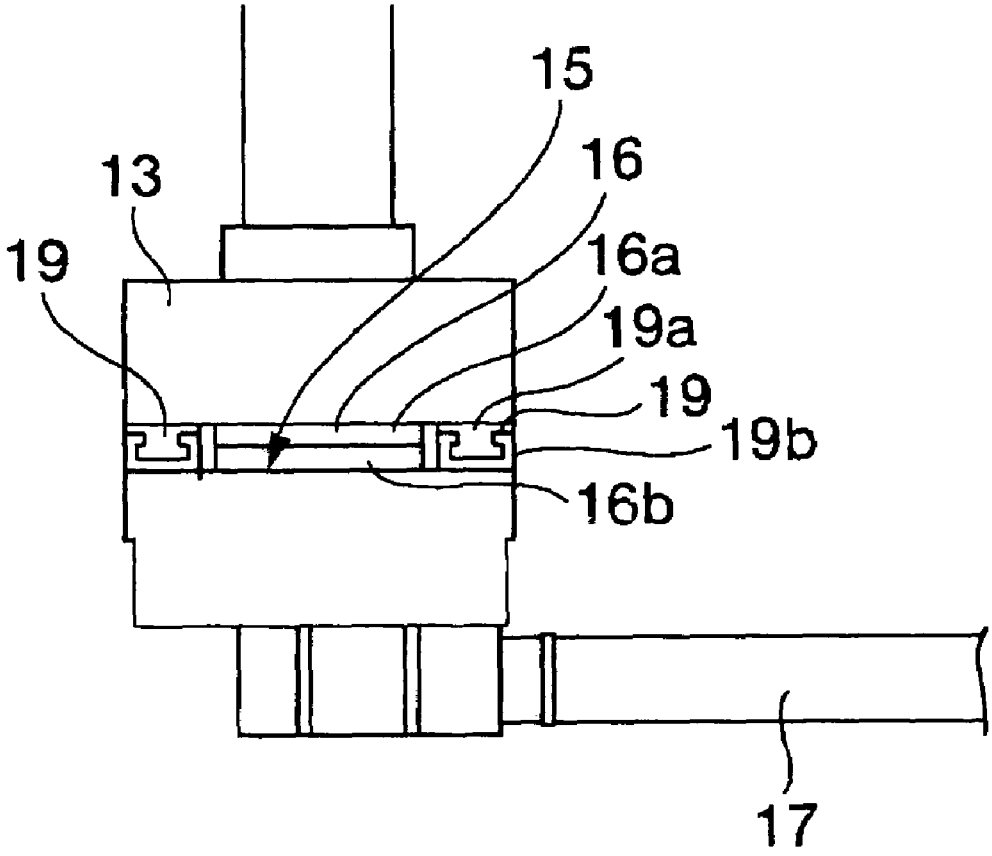
FIG. 18 is an explanatory view in the vicinity of the carrier for T3 of FIG. 17.

Next, sub-carrier moving means according to a fifth embodiment will be explained based on FIG. 16 to FIG. 18. The transfer press 1 used in the fifth embodiment changes the number of sets of a pair of left and right lift beams 13 and 13, and part of the sub-carriers 50 and 50 are omitted with respect to the transfer press 1 shown in FIG. 1 to FIG. 4.

The fifth embodiment is an example that is applied to the case in which the transfer pitch between the working stations is larger than the transfer pitches between the other working stations. Normally, the first process is deep drawing. In this deep drawing process, limitation occurs to the motion of the work transfer apparatus in order to avoid interference between the work and the die when the work is removed from the die. Consequently, in FIG. 16, the transfer motion from the working station W1 that is a deep drawing process to the working station W2 (namely, in the transfer area T1) is set independently from the transfer motions in the other transfer areas T2 to T4. As a result, a more ideal setting is possible for the transfer motions in the transfer area T1 and the transfer areas T2 to T4. Thus, the transfer press 1 has the constitution including a pair of left and right lift beams 13 and 13 for the transfer area T1, and a pair of left and right lift beams 13 and 13 for the transfer areas T2 to T4.

The lift beams 13 and 13 for the T1 are provided with a pair of carriers 15 and 15, and the lift beams 13 and 13 for the T2 to the T4 are provided with a plurality of (three pairs in the fifth embodiment) carriers 15 and 15. The sub-carriers 50 and 50 are provided at the lower parts of the carriers 15 and 15 for the T2 and the T4, which are located at both ends of the lift beams 13 and 13 for the T2 to the T4 as in FIG. 4 to make it possible to be offset. As a result, the cross bar 17 can be moved between the processes with reliability. On the other hand, the carriers 15 and 15 for the T3, which are located at a center of the lift beams 13 and 13 for the T2 To the T4, have the constitution in which the carriers 15 and 15 directly hold the cross bar 17 without being provided with the sub-carriers 50 and 50 as shown in FIG. 17 and 18, since the lift beams 13 and 13 are not divided in the transfer area T3 for which they themselves are responsible.

As explained thus far, the present invention provides the following effects.

(1) A pair of left and right lift beams movable up and down by each lift drive means are provided for each area between the working stations in parallel along the work transfer direction, and the carrier is provided at the lift beam movably along the longitudinal direction thereof. The carrier drive means is attached to each carrier, and the carrier is provided with the sub-carrier movably along the longitudinal direction of the lift beam, and the carrier driving force by the carrier drive means is transmitted to the sub-carrier with the predetermined power transmission means to drive it. As a result, the timing of the feed motion such as the lift stroke, feed stroke, feed level and the like for each area between the working stations can be respectively adjusted, and therefore even in the case of the transfer press with different transfer pitches for a plurality of working stations, work transfer can be carried out with reliability. Accordingly, the die interference curve corresponding to a die can be set, whereby optimal die design can be made.

(2) The cross bar provided with the work holding means is attached to the sub-carrier, which is provided at the carrier movably in the moving direction of the carrier (the work transfer direction), whereby the cross bar can be moved to the position that is offset from the moved position of the carrier. As a result, the work transfer can be carrier out with reliability without being restricted by the length of the lift beam when the adjacent lift beams are spaced from each other and, the middle position of the working station is located at the position in that space, or when the holding positions by the work holding means, that is, the moved position of the cross bar are different when the work is carried in and carried out.

(3) When the carrier is moved to the end portion in the longitudinal direction of the lift beam, the cross bar can be moved to the position past the end portions to the outside. Consequently, connection with the work carrying-in device or the work carrying-out device provided at the upstream side or the downstream side of the working station, for example, is facilitated, and the degree of freedom of the process design is increased.

(4) Since the driving force of the carrier is transmitted to the sub-carrier and drive it, the driving source for the sub-carrier is not necessary, and thus the carrier and the sub-carrier can be constructed to be compact.

(5) By constituting the driving source of the carrier by the linear motor, the carrier can be made light and compact, and resistance against vibration can be increased.

Figure 19:
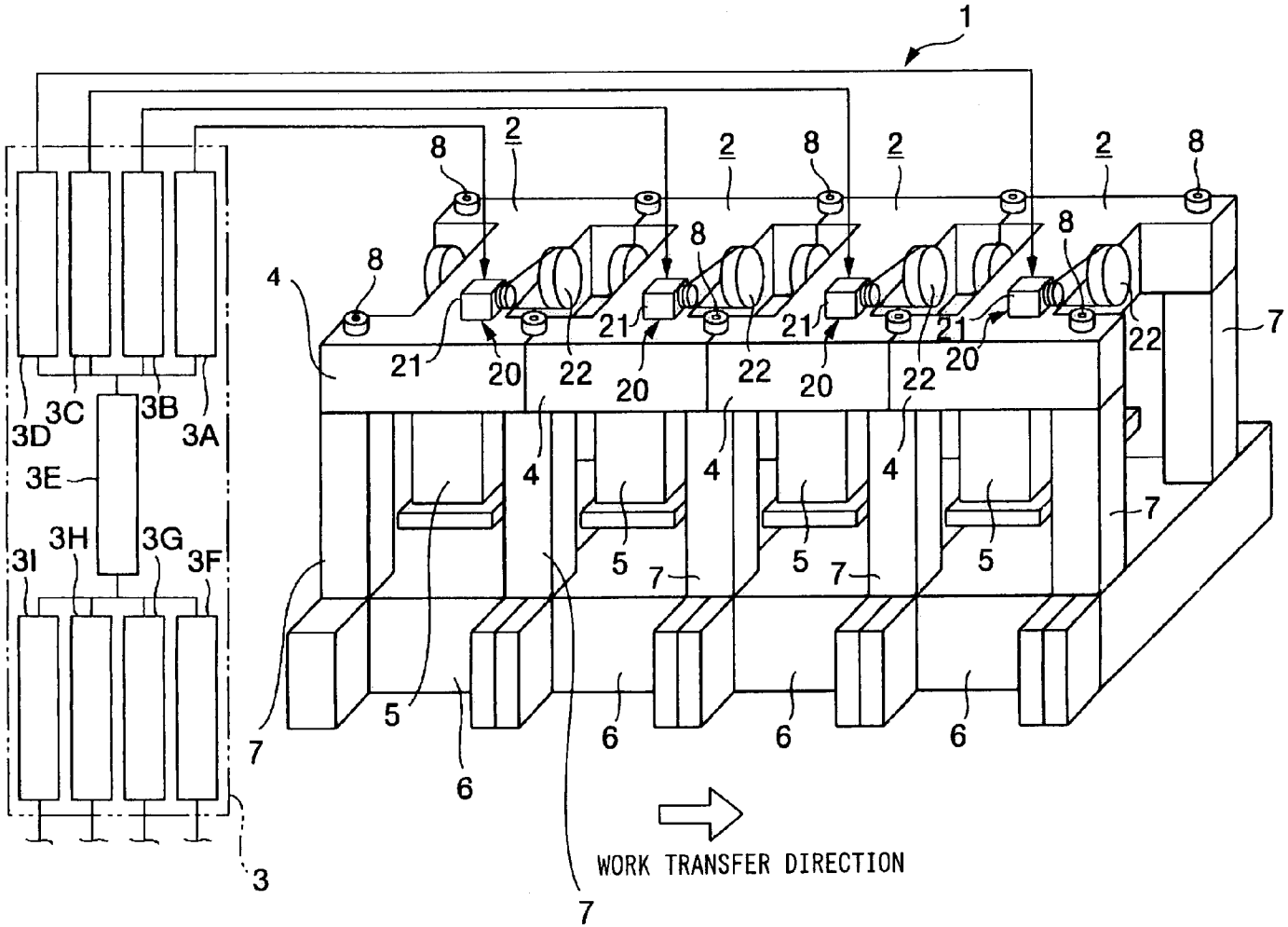
FIG. 19 is an entire perspective view schematically showing a transfer press being another example to which the present invention is applied.
Figure 20:
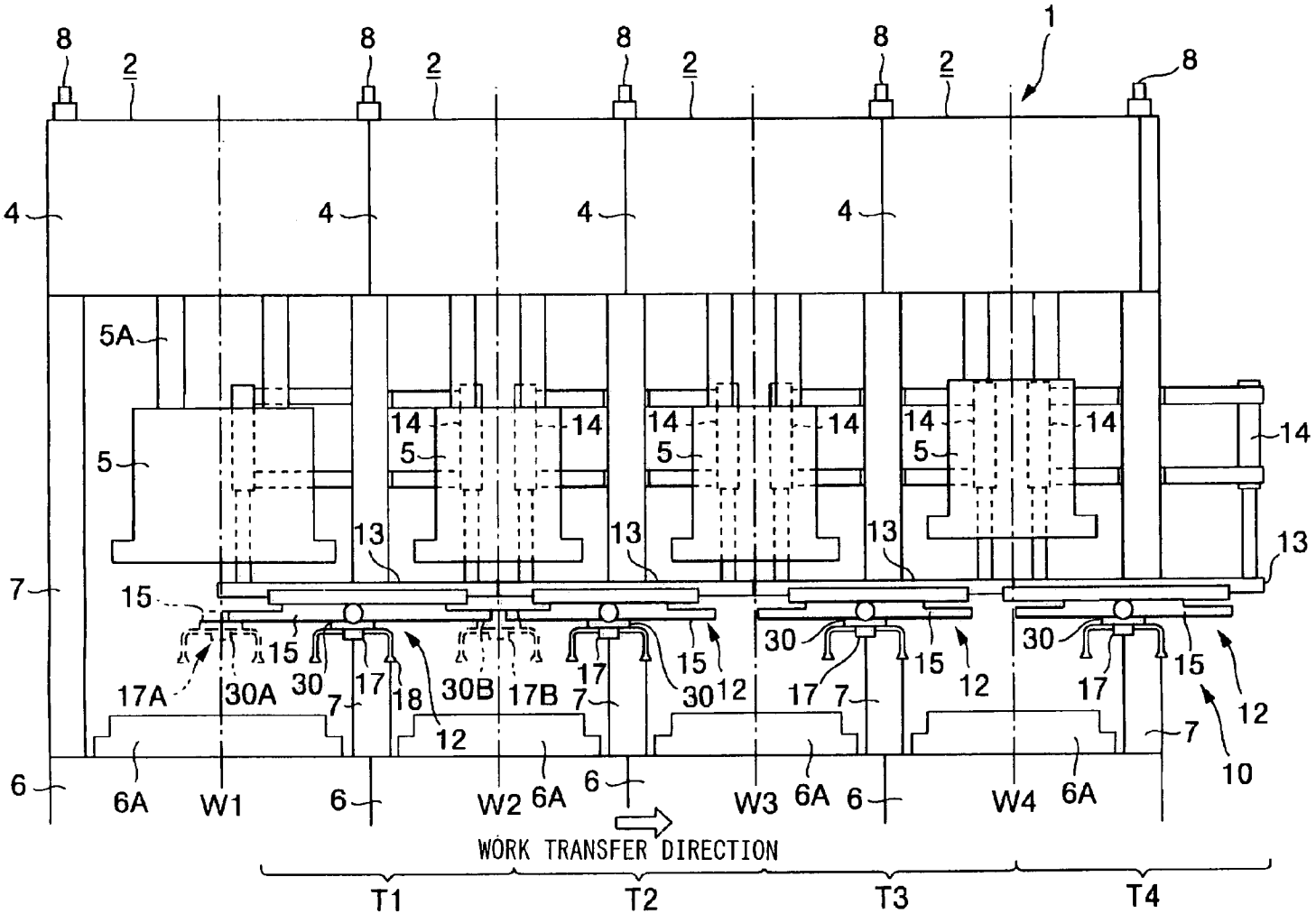
FIG. 20 is a front view of FIG. 19.
Figure 21:
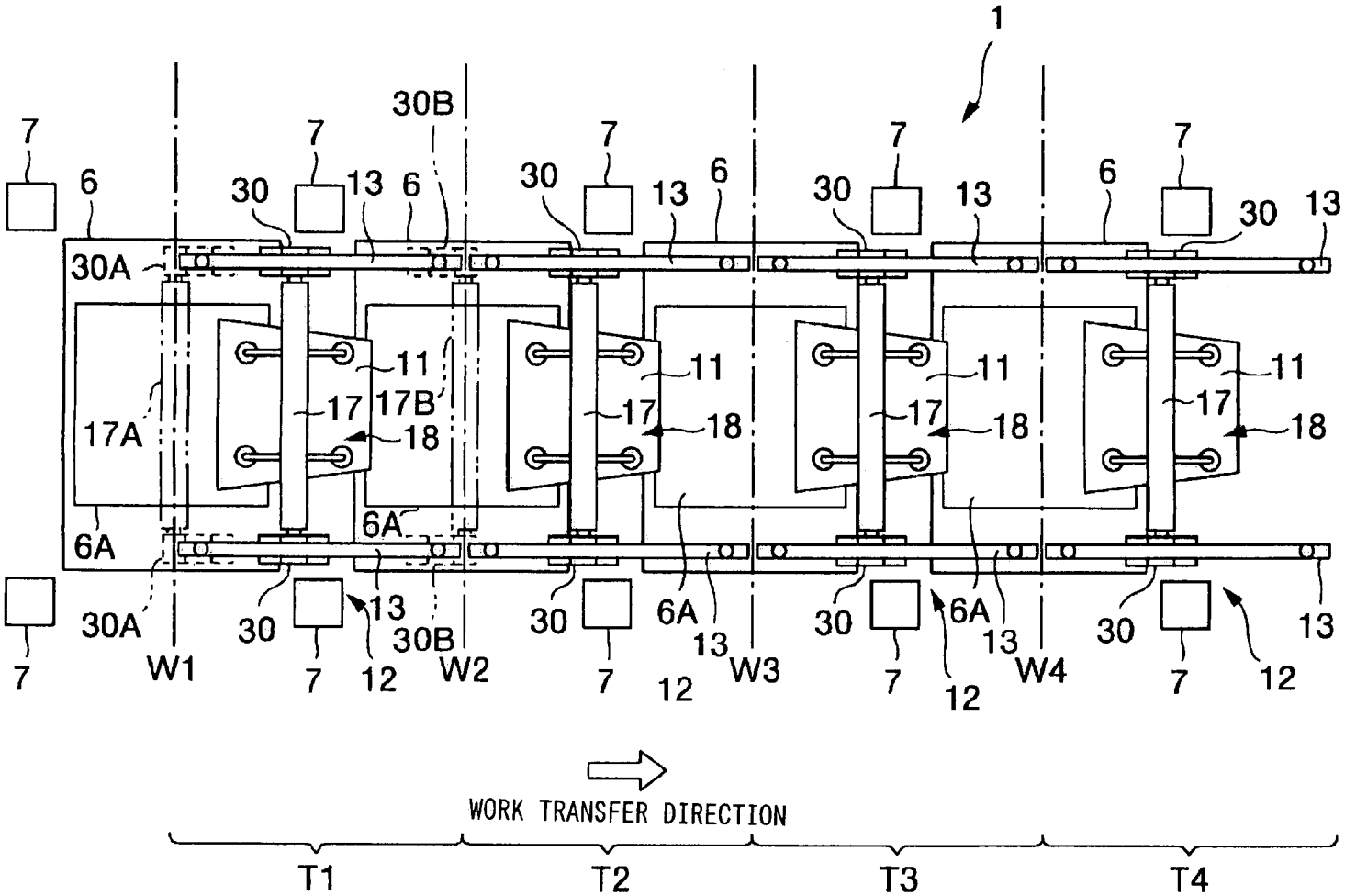
FIG. 21 is a sectional plan view of FIG. 20.
Figure 22:
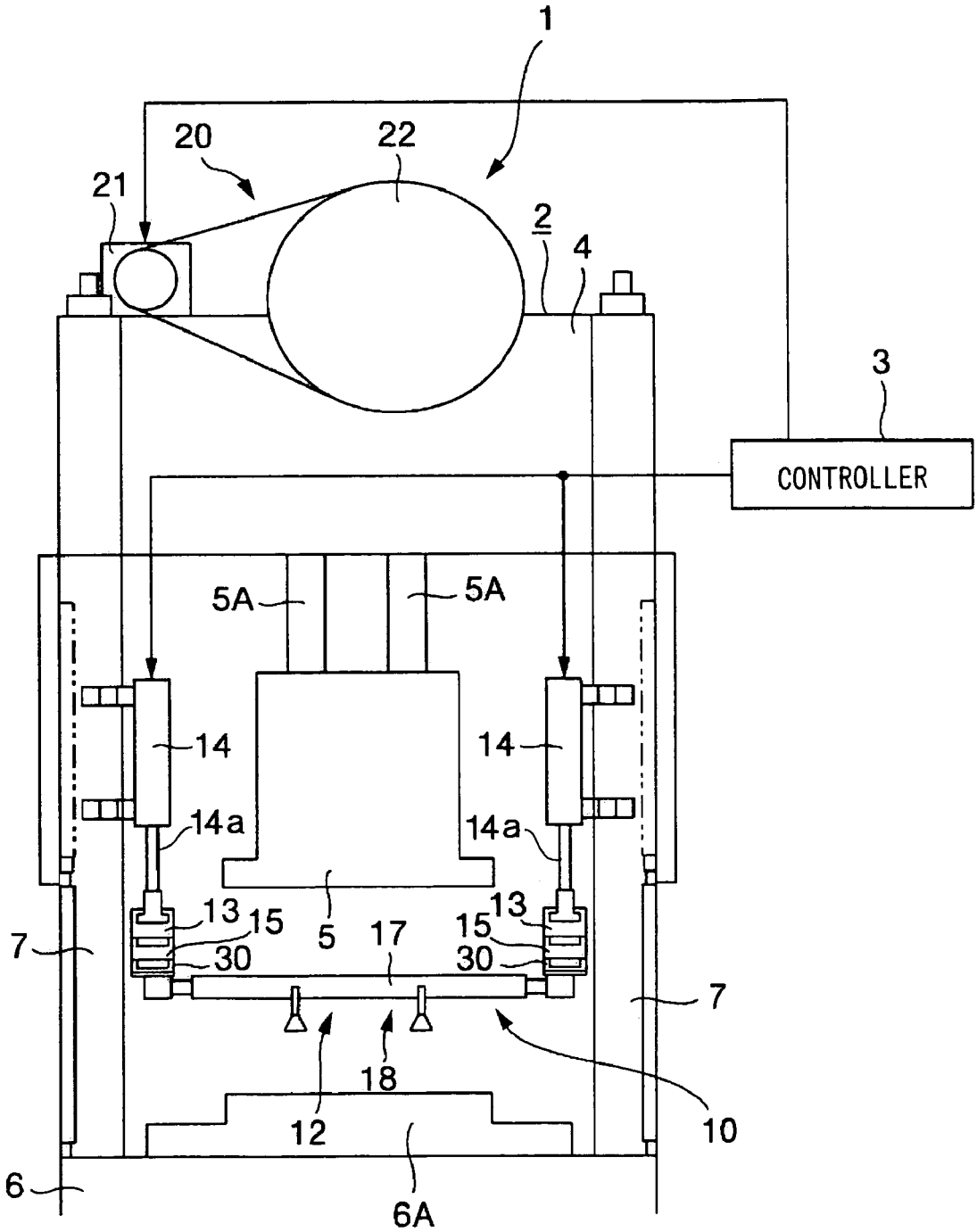
FIG. 22 is a side view of FIG. 20.

Next, the transfer press 1 will be explained based on FIG. 19 to FIG. 22. In a sixth embodiment that will be described later, the transfer press 1 shown in FIG. 19 to FIG. 22 is used. The same components as in the transfer press 1 shown in FIG. 1 to FIG. 4 are given the same reference numerals and symbols, and the explanation thereof will be omitted hereinafter. In the transfer press 1, the left side in FIG. 19 to FIG. 21 is assumed to be an upstream of the transfer of the work 11, and the right side is assumed to be a downstream of the transfer thereof.

The transfer feeder 10 will be explained. The transfer feeder 10 successively transfers the work 11, which is worked in each of the working stations W1 to W4, in the transfer areas T1 to T4, which are set along the adjacent working stations W1 to W4, and is set at the downstream side of the final working station (the W4 in this case). Accordingly, the transfer feeder 10 is constituted by four feed units 12 disposed respectively inside the transfer areas T1 to T4 as shown in FIG. 20 and FIG. 21.

Each of the feed units 12 includes the following components. Namely, first of all, it includes a pair of left and right lift beams 13 and 13 movable up and down, which are placed in parallel along the work transfer direction and spaced in a horizontal direction so as not to interfere with the slide motion. At upper portions of a pair of the left and right lift beams 13 and 13, provided are lift drive means having lift shaft servo motors 14 and 14, and support members 14*a* which are attached to the lift beams 13 and 13 and driven up and down by the lift shaft servo motors 14 and 14. By outputting control signals to the respective lift drive means from the corresponding T1 to T4 control means 3F to 3I, the lift beams 13 are driven to move up and down. At lower portions of the respective lift beams 13 and 13, provided are carriers 15 and 15 to be movable in a longitudinal direction of the lift beam 13. Between the lift beams 13 and the carriers 15, included are carrier drive means having linear motors 16 and 16 (see FIG. 24) for driving the respective carriers 15 in the longitudinal direction of the lift beam 13. Carrier movement is controlled by outputting control signals to the respective carrier drive means from the corresponding T1 to T4 control means 3F to 3I.

Further, sub-carriers 30 and 30 are provided at lower parts of the respective carriers 15 and 15 to be movable in the longitudinal direction of the lift beam 13. Linear motors 31 and 31 as sub-carrier drive means for driving the sub-carriers 30 in the moving direction of the carrier 15, that is, in the longitudinal direction of the lift beam 13 are provided between the carriers 15 and the sub-carriers 30. The cross bar 17 is spanned between the sub-carriers 30 and 30 provided at a pair of the left and right carriers 15 and 15 which are opposing each other. The cross bar 17 is provided with a vacuum cup device capable of sucking, for example, the work 11 at a predetermined number of spots (four spots in this embodiment) as the work holding means 18. A control signal is inputted into the work holding means 18 of each of the cross bars 17 from the corresponding T1 to T4 control means 3F to 3I, whereby the operation of suction is controlled.

Figure 23:
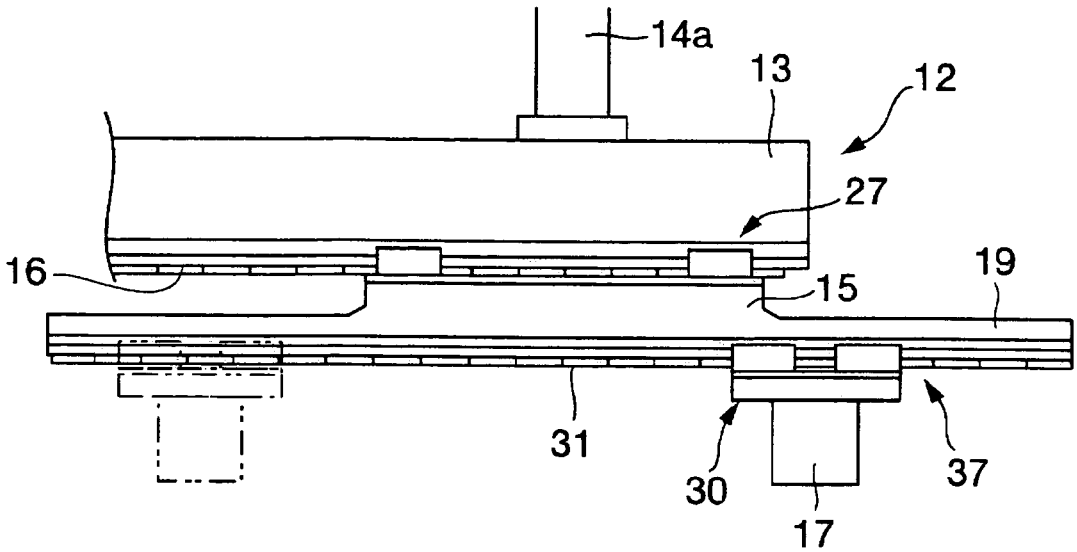
FIG. 23 is a front view of sub-carrier drive means according to a sixth embodiment of the present invention.

Next, sub-carrier drive means according to the sixth embodiment will be explained in detail based on FIG. 23 and FIG. 24. FIG. 23 is a front view of the sub-carrier drive means of the sixth embodiment, and FIG. 24 is a right side view of FIG. 23.

Figure 24:
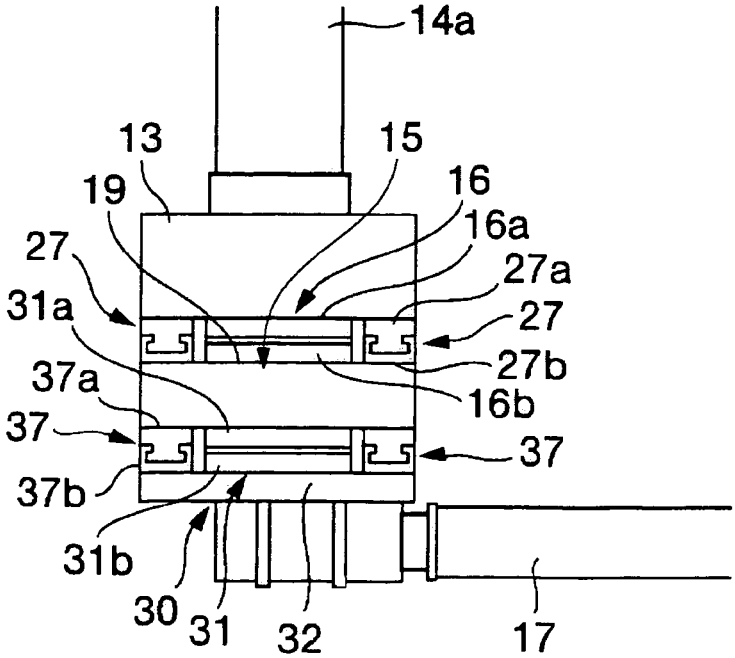
FIG. 24 is a right side view of FIG. 23.

As shown in FIG. 23 and FIG. 24, the linear motor 16 is placed along the work transfer direction between the lift beam 13 and a frame 19 of the carrier 15, and linear guides 27 and 27 are placed along the work transfer direction at both sides of the linear motor 16. A guide rail 27*a* of each of the linear guides 27 is attached at a bottom surface of the lift beam 13 and a guide member 27*b* of the linear guide 27 is attached at a top surface of the aforementioned frame 19. The guide member 27*b* is slidably engaged with the guide rail 27*a* in a state in which it is suspended from the guide rail 27*a*. Each of the linear motors 16 enables each of the carriers 15 to be self-propelled independently along the linear guides 27. Any one of a primary coil 16*a*, and a secondary conductor (constituted by a ferromagnetic material or permanent magnet or the like) 16*b*, which constitute the linear motor 16, is laid on the lift beam 13 side, and the other one is laid on the carrier 15 side to oppose the aforementioned one of them. The carrier 15 can be made to travel at an optional speed along the linear guides 27 by inputting a control signal into the primary coil 16*a* from each corresponding T1 to T4 control means 3F to 3I.

The linear motor 31 is placed along the work transfer direction between the frame 19 of the carrier 15 and a frame 32 of the sub-carrier 30, and linear guides 37 and 37 are placed at both sides of the linear motor 31 along the work transfer direction. A guide rail 37*a* of each of the linear guides 37 is attached to a bottom surface of the frame 19 of the carrier 15 and a guide member 37*b* of the linear guide 37 is attached to a top surface of the frame 32 of the sub-carrier 30. The guide member 37*b* is slidably engaged with the guide rail 37*a* in a state in which it is suspended at the guide rail 37*a*. The guide rail 37*a* is attached so that it protrudes outward in the carrier moving direction from the end portion in the longitudinal direction of the lift beam 13 when the carrier 15 is moved to the end portion in the longitudinal direction of the lift beam 13.

Each of the linear motors 31 enables the sub-carrier 30 thereof to be self-propelled independently along the linear guide 37. Out of a primary coil 31*a* and a secondary conductor (constituted by a ferromagnetic material, permanent magnet or the like) 31*b*, any one of them is laid on the frame 19 side of the carrier 15, and the other one of them is laid on the frame 32 side of the sub-carrier 30 so as to oppose the aforementioned one of them. By inputting a control signal into the primary coil 31*a* from each of the corresponding T1 to T4 control means 3F to 3I, the sub-carrier 30 can be made to travel at an optional speed along the linear guide 37.

Next, an operation of the sub-carrier drive means with the above-described constitution will be explained. When the carrier 15 is driven by the linear motor 16, the carrier 15 is moved in the longitudinal direction of the lift beam 13. When the sub-carrier 30 is driven by the linear motor 31, the sub-carrier 30 is moved in the moving direction of the carrier 15. As a result, the sub-carrier 30 is moved further offset with respect to the carrier 15. Accordingly, a moving amount of the cross bar 17 is the total of adding up the moving amounts of the carrier 15 and the sub-carrier 30, and by controlling the moving amounts of the carrier 15 and the sub-carrier 30 to be predetermined amounts, the position of the cross bar 17, that is, the transfer position of the work 11 can be controlled.

Here, a transfer method of the work 11 by the transfer feeder 10 with the above constitution will be explained with reference to FIG. 20 and FIG. 21. First, in the transfer area T1, when working in the working station W1 is finished and the slide 5 starts to rise, the carrier 15 of the lift beam 13 at a position with predetermined height is moved toward the end portion at the side of the working station W1 along the lift beam 13 by the linear motor 16. In this situation, when the work transfer distance is satisfied by only the moving distance of the carrier 15, the sub-carrier 30 is set at substantially the middle position, in the work transfer direction, of the carrier 15 and has no need to be moved.

However, when the work transfer distance is not satisfied by only the moving distance of the carrier 15, namely, when the position of the working station W1 is located at an outer side from the end portion of the lift beam 13, the sub-carrier 30 is moved so as to be offset by predetermined distance to the working station W1 from substantially the middle position in the work transfer direction, of the carrier 15 by the linear motor 31. As a result, the sub-carrier 30 and the cross bar 17 are moved to above substantially the middle position of the working station W1 (see the sub-carrier 30A and the cross bar 17A shown by the chain double-dashed line in FIG. 20 and FIG. 21), and the vacuum cup device (the work holding means 18) is moved to the work suction position of the working station W1. Next, the lift beam 13 is lowered at this position and the work 11 is sucked.

Thereafter, the lift beam 13 is raised, then the carrier 15 is moved to the downstream side, that is, the end portion of the working station W2, and as in the above description, the sub-carrier 30 is moved by predetermined distance in the downstream direction as the carrier 15, as occasion demands. Then, the sub-carrier 30 and the cross bar 17 are moved to substantially the middle position (see the sub-carrier 30B and the cross bar 17B shown by the chain double-dashed line in FIG. 20 and FIG. 21) of the working station W2 by being offset by the predetermined distance to the working station W2 from substantially the middle position of the carrier 15 in the work transfer direction. Thereby, the vacuum cup device (the work holding means 18) is located at a work release position of the working station W2. Then, the lift beam 13 is lowered at this position and the work 11 is released. Subsequently, before the slide 5 of the working station W2 is not completely lowered, namely, before press working is not started in the working station W2, the lift beam 13 is raised, and the carrier 15 is returned to substantially the middle position of the transfer area T1 so that the sub-carrier 30 and the cross bar 17 do not interfere with the slide 5 and the die.

Subsequently, after working in the working station W2 is finished, as the feed unit 12 in the transfer area T1, the cross bar 17 is also moved by the movement of the lift beam 13, the carrier 15, and the sub-carrier 30 in the transfer area T2. In the transfer areas T3 and T4, the respective field units 12 are similarly driven in the same manner as above, whereby carrying-in and carrying-out of the work are performed in all the transfer areas T1 to T4, and the work is finally transferred to a production carrying out device or the like not shown from the transfer area T4. Actually, the carrier 15 and the sub-carrier 30 are not moved in a state in which the lift beam 13 is standing still, but they are moved during up and down movement of the lift beam 13. As a result, efficient transfer can be carried out by the simultaneous drive of the drive shaft, and the working speed (operation strokes per minute) can be increased.

Next, the effects according to the sixth embodiment will be explained.

(1) In the transfer press having a plurality of working stations, a pair of lift beams 13 and 13 corresponding to each area between the adjacent working stations are provided in parallel along the work transfer direction to be movable up and down. The respective lift beams 13 and 13 are provided with the carriers 15 and 15 which are driven along the longitudinal direction thereof by the predetermined drive means (the linear motor 16 in the sixth embodiment), and the carriers 15 and 15 are provided with the sub-carriers 30 and 30 movably in the longitudinal direction of the lift beam 13. In addition, the sub-carriers 30 and 30 are driven by the linear motors 31 and 31, the cross bar 17 provided with the work holding means 18 such as a vacuum cup device is spanned between a pair of the sub-carriers 30 and 30 which are opposing each other.

Consequently, by controlling the moving distances of the carriers 15 and 15 and the sub-carriers 30 and 30 which are corresponding to each area between the working stations, the feed stroke of the cross bar 17 can be adjusted for each area between the working stations. As a result, in the transfer press in which the transfer pitch for each area between the adjacent working stations differs, work transfer can be also carried out with reliability. Accordingly, in such a case, the length of the transfer press line can be designed to be optimally short as compared with the prior art in which all of the transfer pitches are designed to conform to the maximum transfer pitch. Even in the transfer press in which the uprights exist between the working stations, the work can be directly transferred to the next working station without providing the idle stations at the uprights, and therefore the length of the entire transfer press line including all of the working stations can be reduced.

(2) Since the rising and lowering stroke of the lift beam 13 and the feed stroke of the cross bar 17 can be adjusted for each of the working stations, the feed motion of the work holding means and its timing can be adjusted for each of the working stations. The origin position (feed level) of each of the working stations can be set at the position corresponding to dies. As a result, work transfer corresponding to the dies can be set for each process, and optimal die design can be made.

(3) Since the drive means of the carrier 15 and the sub-carrier 30 are constituted by the linear motors 16 and 31, respectively, the constitutions of the carrier 15 and the sub-carrier 30 are made simple and compact. Consequently, the work transfer apparatus can be reduced in weight and size, and therefore the volumetric capacity of the other driving sources in the work transfer apparatus can be reduced, thus reducing production cost. By reducing the weight of the work transfer apparatus, chatter of the bars at the time of actuation and stoppage and at the time of inching can be controlled, and durability of each part of the work device can be improved. Further, since increase of speed and accuracy of position can be achieved by the linear motors, even when there is an area having a longer transfer pitch than the other areas between a plurality of working stations, slaved following can be sufficiently performed, thus making it possible to correspond to a high-speed operation of the press.

(4) In the sixth embodiment, each of the carriers 15 is provided with the sub-carrier 30 at which the cross bar 17 is spanned, but this is not restrictive. For example, according to the necessity of the degree of freedom of the design of a die, necessity of a large feed stroke, and the like, a desired position is determined out of a plurality of carriers 15 and only the corresponding carrier 15 may be provided with the sub-carrier 30. In this case, the work transfer distance can be optionally set by the feed stroke of only the carrier 15, and adding up the strokes of the carrier 15 and the sub-carrier 30. Explaining with regard to use, there is a case in which a transfer pitch between the working stations is larger than the transfer pitches between the other working stations. For example, in the working station (W1) at the uppermost stream side of the transfer press, a blank material is worked, thus the size of the die is larger as compared with the size of the dies of the following processes,_and the transfer pitch between the working station (W1) and the working station (W2) is larger than the transfer pitches between the working stations of the following processes.

Figure 30:
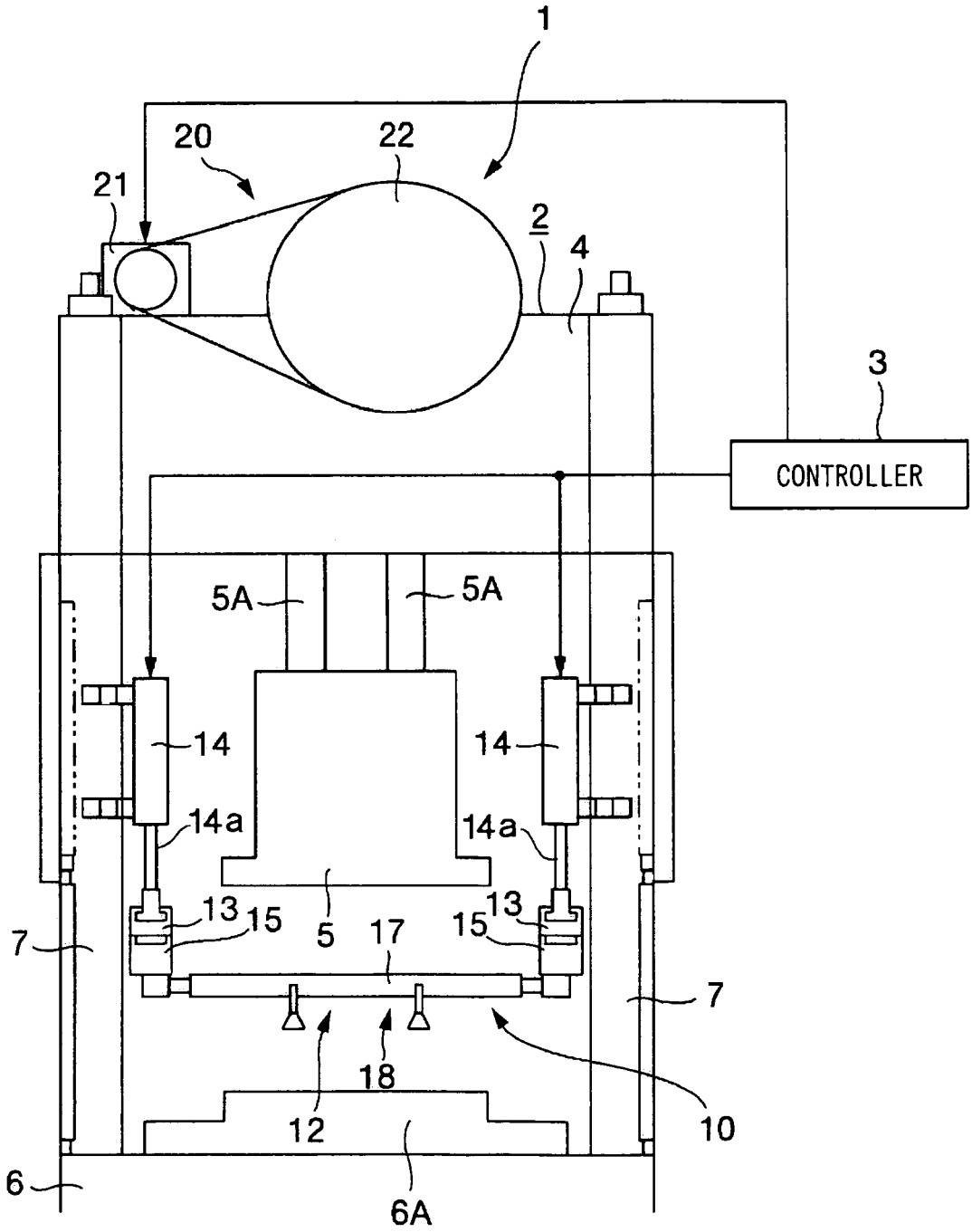
FIG. 30 is a modified example of the sixth embodiment, and is a side view of a transfer press showing carriers between which a cross bar is directly spanned laterally.
Figure 31:
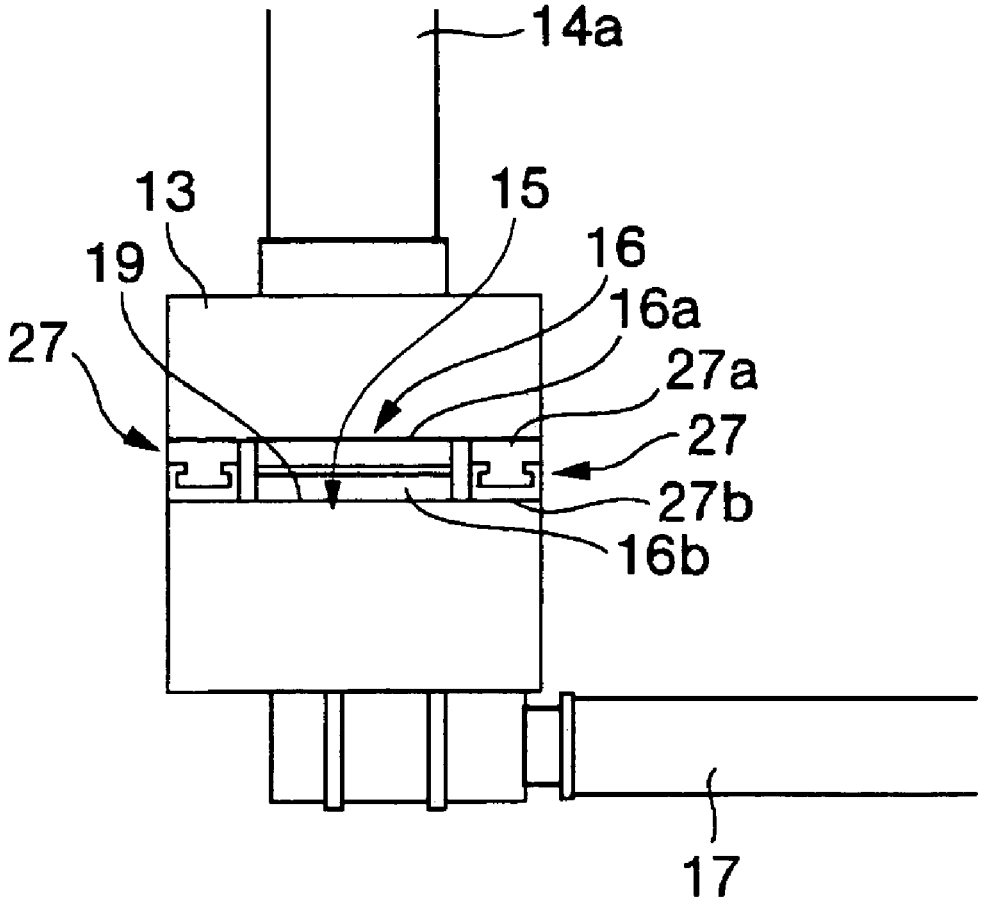
FIG. 31 is an explanatory view of a vicinity of the carrier in FIG. 30.

In this case, a pair of carriers 15, which are opposing each other and include the sub-carriers 30 between which the cross bar 17 is spanned, are provided in the transfer area between the working stations with the larger transfer pitch. As a result, a larger feed stroke can be set than the transfer areas between the other working stations which are provided with the carriers 15 (see FIG. 30 and FIG. 31) between which the cross bar 17 is directly spanned laterally, and therefore an optimal die design is possible. As described above, only the lift beams 13 corresponding to the required working station are provided with a pair of the carriers 15, which are opposing each other and includes the sub-carriers 30 between which the cross bar 17 is laterally spanned, whereby the cost can be reduced to the minimum required amount.

(5) It is constituted that when the carrier 15 is moved to the end portion in the longitudinal direction of the lift beam 13, the guide rail 37*a* of the linear guide 37, for guiding the sub-carrier 30 provided at the carrier 15, exceeds the end portion in the longitudinal direction of the lift beam 13 outward in the carrier moving direction. As a result, the cross bar 17 can be moved to the position past the end portion of the lift beam 13 outward. Consequently, even when a plurality of lift beams 13 are disposed substantially in line in the work transfer direction and the adjoining portions of the adjacent lift beams 13 are at substantially the center of the working station, work can be transferred to the die position at substantially the center of the working station with reliability, and there is no limitation in the transfer pattern. Further, for example, when the material supply device, the product carrying-out device (both are not illustrated), or the like is placed at the upstream or the downstream side of the working station, work transfer can be performed correspondingly to various kinds of material supply devices and the product transfer devices without being restricted by the length in the transfer direction of the lift beam 13, and therefore the degree of freedom of the process design of the transfer press line is increased.

Figure 25:
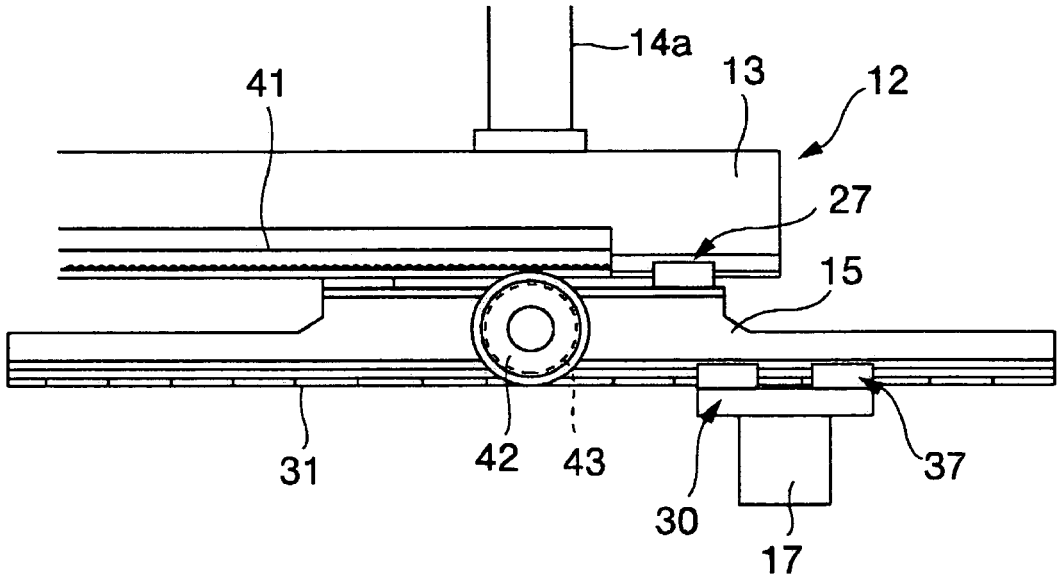
FIG. 25 is another example of the sub-carrier drive means according to a sixth embodiment.

In the sixth embodiment, an example using the linear motor 16 as the carrier drive means is shown, but this is not restrictive. For example, as shown in FIG. 25, a pinion 42 rotationally driven by a servo motor 43 and a rack 41 attached in the longitudinal direction of the lift beam 13 may be meshed with each other, and thereby the carrier 15 may be driven by the servo motor 43. Alternatively, a power transmission mechanism such as a ball screw may be used. In the sixth embodiment, the lift beam 13 is independent for each process, but the lift beam 13 may be independent for a plurality of processes. In this case, a plurality of carriers are provided on one lift beam 13 to perform work transfer between the respective working stations.

In a work transfer apparatus, in which a long lift beam extending along all the working stations is provided, carriers are connected to each other, and each of the carriers makes the same motion and the same stroke with one feed drive means as in the prior art, the feed stroke of the cross bar can be adjusted for each working station by providing sub-carriers at the carriers. By further driving the sub-carriers with the linear motor, an increase in the weight of the work transfer apparatus can be controlled to a minimum.

Figure 26:
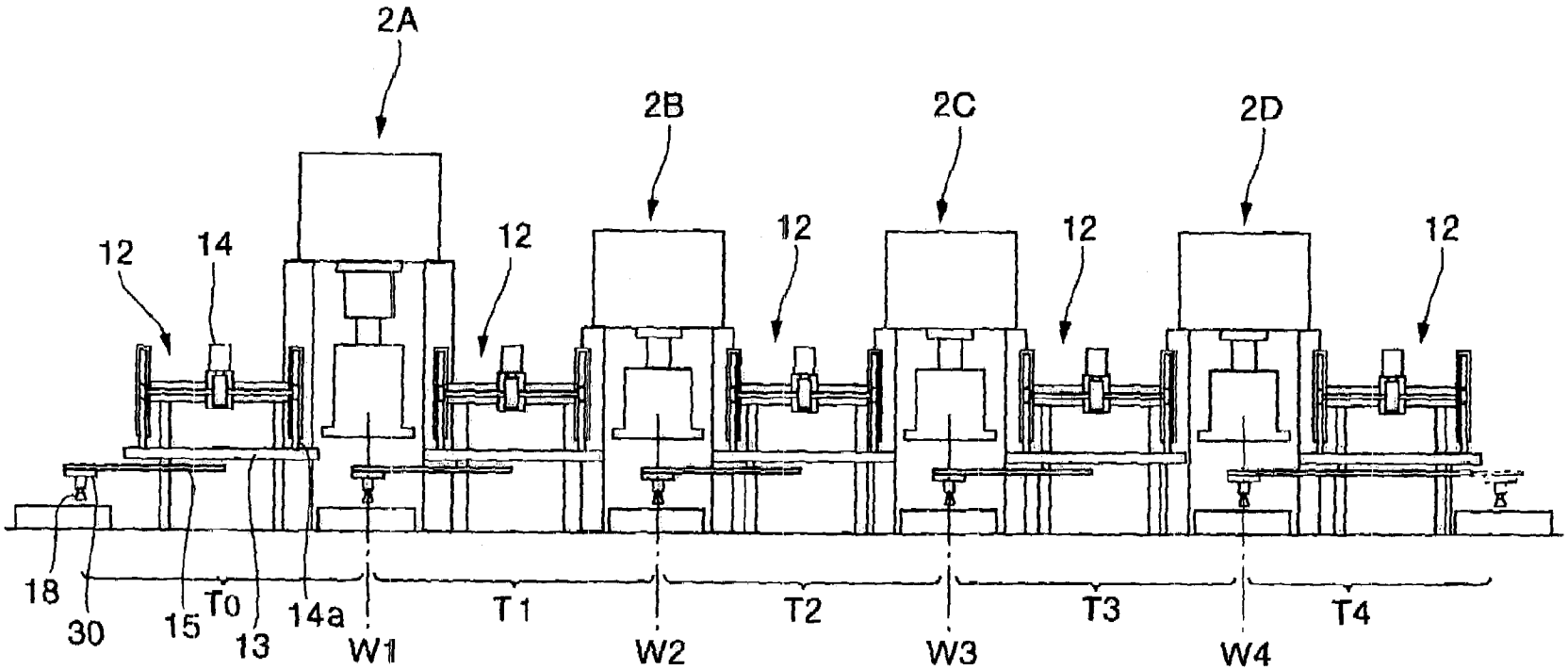
FIG. 26 is a front view of a work transfer apparatus according to a seventh embodiment of the present invention.
Figure 27:
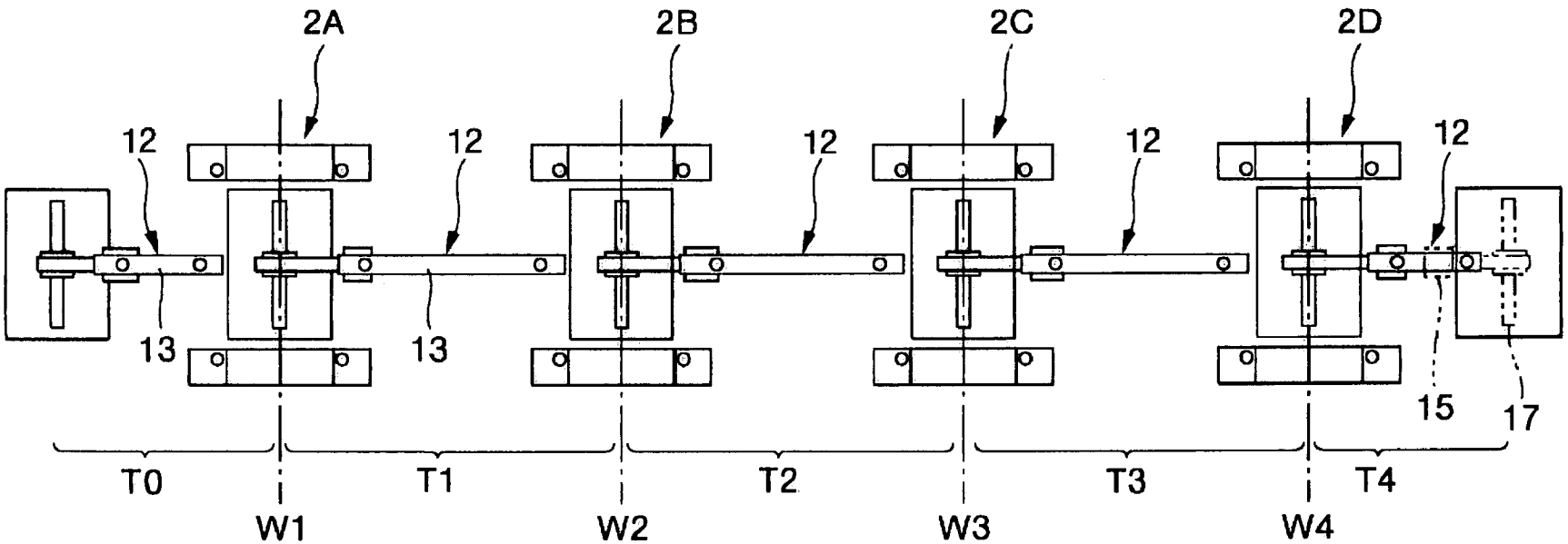
FIG. 27 is a plan view of FIG. 26.
Figure 28:
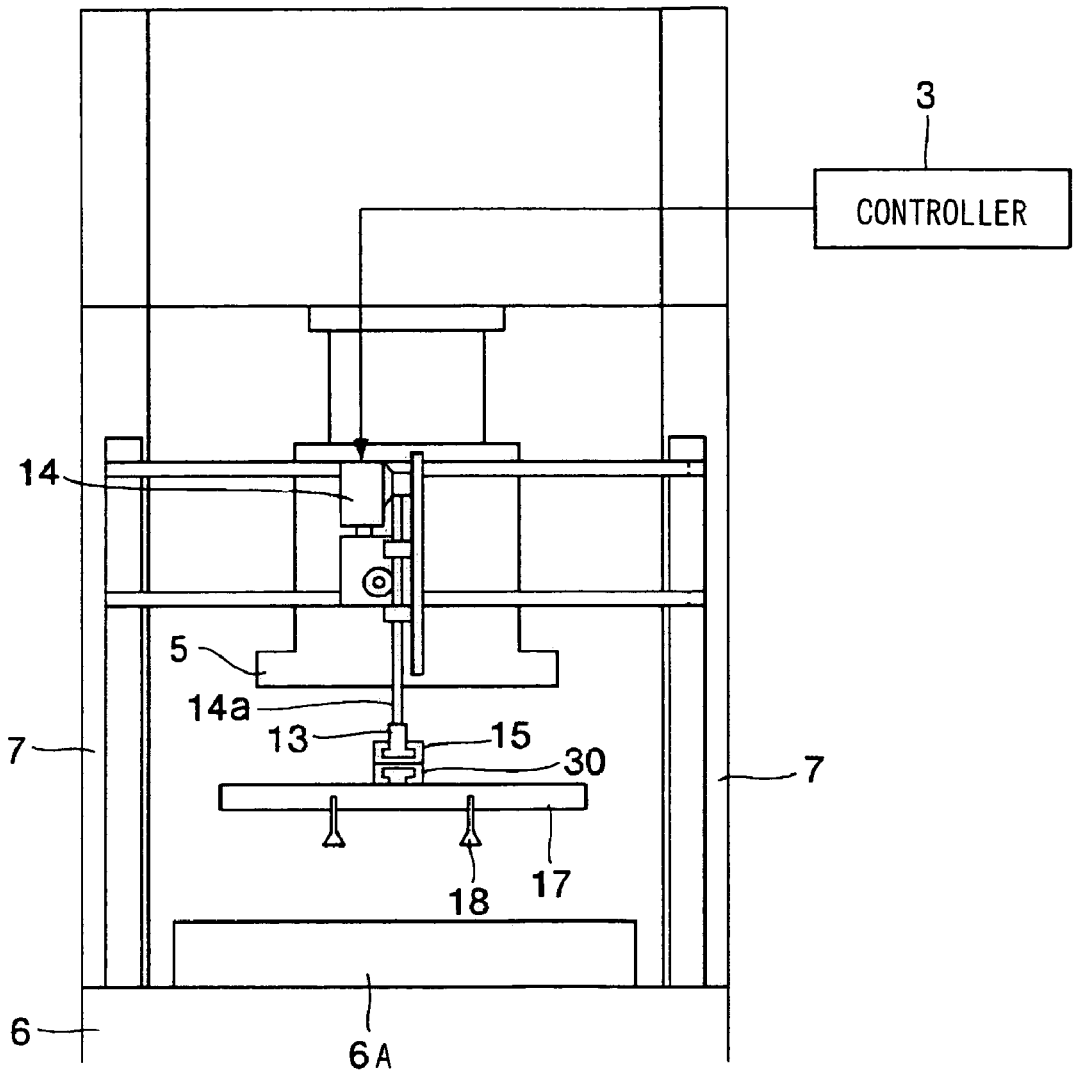
FIG. 28 is a side view of FIG. 26.

The lift beams 13 in the sixth embodiment are provided in parallel with the work transfer direction and in pairs in the lateral direction. However, as shown in FIG. 26, FIG. 27 and FIG. 28 according to a seventh embodiment, they may be placed at substantially the center in the lateral direction without being paired. In this case, the lift beam 13 is placed so as not to be in the press working area between the slide 5 and the bolster 6A, and the cross bar 17 is moved at the moving stroke of the sub-carrier 30 to substantially the center of the working station from the end of the lift beam 13. FIG. 26, FIG. 27 and FIG. 28 shows the case of a tandem press line constituted by presses 2A, 2B, 2C and 2D, and this work transfer apparatus may be used in a transfer press.

Figure 29:
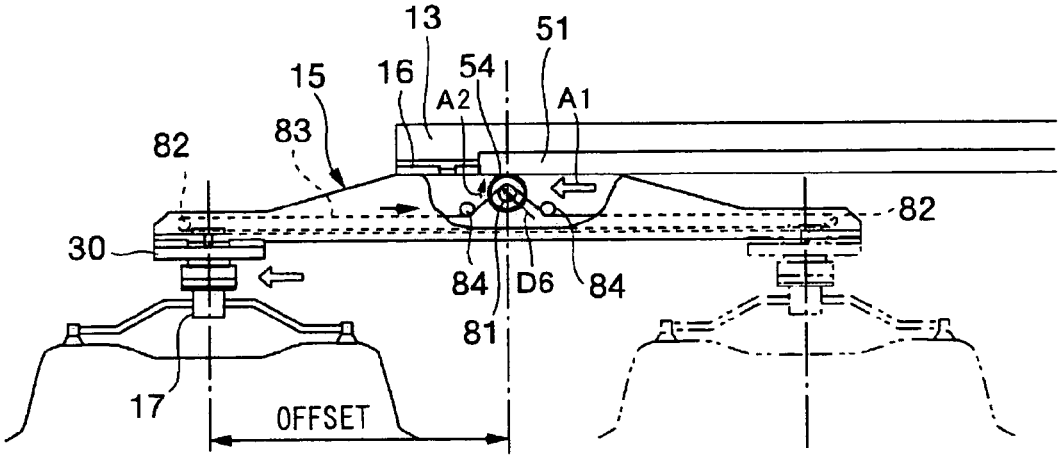
FIG. 29 is another example of sub-carrier drive means according to the seventh embodiment.

It is not necessary that the drive means of the sub-carrier is a linear motor as to the construction in which the guide for guiding the aforementioned sub-carrier is protruded in the moving direction of the carrier from the end portion of the lift beam when the carrier is moved to the end portion of the lift beam. Namely, the drive means may be other drive means, and the constitution, in which the sub-carrier does not have its own drive source and moves following the movement of the carrier, may be adopted. FIG. 29 shows an embodiment in which the sub-carrier moves following the movement of the carrier.

In FIG. 29, a pinion shaft is rotatably provided at substantially the center portion on the side surface of the carrier 15, and the pinion 54 is attached at the end portion of the outer side of the pinion shaft. The pinion 54 is meshed with the rack 51 provided at the side surface of the lift beam 13. The pulley 81 is attached at the other end portion of the pinion shaft. The pulleys 82 and 82 are rotatably provided at both end portions in front and at the rear of the carrier 15 in the longitudinal direction of the lift beam 13 (namely, the work transfer direction), and the endless belt 83 such as a timing belt is wound around the pulley 81 and the pulleys 82 and 82. The sub-carrier 30 is attached to the endless belt 83 between the front and the rear pulleys 82 and 82, and predetermined tension is given to the endless belt 83 with the tension pulleys 84 and 84 provided in the vicinity of the areas in front and behind the pulley 81. According to this constitution, the sub-carrier 30 moves following the movement of the carrier 15 and moves along the longitudinal direction of the lift beam 13.

As explained in the above-described sixth and seventh embodiments and the like, the present invention provides the following effects.

(1) The lift beam movable up and down by the lift drive means is provided in parallel along the work transfer direction, the carrier is provided at the lift beam movably along the longitudinal direction thereof, and the sub-carrier is provided at the carrier movably along the longitudinal direction of the lift beam by the linear motor. Consequently, timing of the feed motions such as a lift stroke for each of the lift beams or each pair of the lift beams, feed stroke, and feed level can be adjusted respectively, work transfer can be performed with reliability even in the case of a transfer press with different transfer pitches between the working stations. Accordingly, work transfer corresponding to a metal die can be set, whereby optimal die design can be made.

(2) The sub-carrier is attached to the carrier movably in the carrier moving direction (work transfer direction), and the work holding means or the cross bar provided with the work holding means is attached to the sub-carriers. As a result, the work holding means can be moved to the position which is offset outward in the carrier moving direction from the middle position of the carrier. Consequently, when the adjacent lift beams are spaced, and the center position of the working station is located at the spaced position, or when the holding position by the work holding means or the moved position of the cross bar differs at the time of carrying in and carrying out the work in the same working station (die), the work transfer can be performed with reliability without being restricted by the length of the lift beam.

(3) By constituting the driving source of the sub-carrier by the linear motor, the constitution of the carrier and the sub-carrier is made simple and compact, and the work transfer apparatus can be reduced in weight and size, thus making it possible to reduce the volumetric capacity of the other driving sources in the work transfer apparatus and reduce the production cost. By reducing the work transfer apparatus in weight, chatter of the bars at the time of actuation and stoppage and at the time of inching can be reduced, and the durability of each component of the work apparatus can be increased. Further, since increase of speed and accuracy of the position can be enhanced by the linear motor, even when there is a spot with a longer transfer pitch than the other spots between a plurality of working stations, slaved tacking can be sufficiently performed, which makes it possible to correspond to a high speed operation of the press.

(4) A pair of carriers opposing each other, which are provided with the sub-carriers between which the cross bar is laterally spanned, are provided at only the lift beams corresponding to the transfer area requiring a larger feed stroke than the transfer areas between the other working stations, whereby the cost can be reduced as necessary.

(5) Since the cross bar can be moved to the position past the end portion outward when the carrier is moved to the end portion in the longitudinal direction of the lift beam, for example, connection to the material supply device or the production carrying-out device provided at the upstream side or the downstream side of the working station is facilitated, and the degree of freedom of the process design is increased.

The invention claimed is:

1. A work transfer method for a transfer press, comprising:

moving a pair of lift beams up and down, wherein the pair of lift beams are parallel to a work transfer direction;

reciprocatingly moving a cross bar based on a predetermined feed motion, wherein the cross bar is laterally spanned between a pair of carriers provided at the pair of lift beams to oppose each other, and wherein the cross bar is provided with a work holding unit for holding a work;

providing a carrier driving force directly to the carriers to move each carrier of the pair of carriers in a same moving direction along a longitudinal direction of the pair of lift beams; and utilizing the movement of the pair of carriers to drive the cross bar to move to an offset position with respect to a moved position of the pair of carriers in a same direction as the direction of the movement of each of the pair of carriers.

2. The work transfer method for the transfer press according to claim 1, wherein the offset position is a position in which the cross bar is positioned beyond end portions of the pair of lift beams, when the pair of carriers are moved to substantially an end portion of the pair of lift beams in the longitudinal direction of the lift beams.

3. A work transfer apparatus for a transfer press, comprising:

at least one pair of lift beams which are provided in parallel with a work transfer direction and which are movable up and down;

at least one pair of carriers which are provided at each of the at least one pair of lift beams, and which are movable along a longitudinal direction of the at least one pair of lift beams;

a pair of guides provided on at least one of the at least one pair of carriers;

a pair of sub-carriers which are provided on the pair of carriers along the pair of guides, and which are movable in a carrier moving direction;

a driving source to provide a carrier driving force directly to the carriers to move the carriers along the longitudinal direction of the at least one pair of lift beams;

a power transmission unit which transmits the carrier driving force to the pair of sub-carriers; and a cross bar which is laterally spanned between each pair of sub-carriers, and which is provided with a work holding unit for holding a work;

wherein the carrier driving force is transmitted to the sub-carriers to move the cross bar and each of the sub-carriers to an offset position with respect to a moved position of the pair of carriers in a same direction as the moving direction of each carrier of the pair of carriers.

4. The work transfer apparatus for the transfer press according to claim 3, further comprising an additional cross bar laterally spanned directly between, an additional pair of carriers.

5. The work transfer apparatus for the transfer press according to claim 3, wherein the pair of guides protrude from end portions of the pair of lift beams in the carrier moving direction to guide the pair of sub-carriers, when the pair of carriers provided with the sub-carriers are moved up to substantially the end portions of the pair of lift beans in the, longitudinal direction of the pair of lift beams.

6. The work transfer apparatus for the transfer press according to claim 3, wherein the power transmission unit comprises:

a first rack which is provided on a lift beam of the pair of lift beams provided with the sub-carriers along the longitudinal direction of the lift beam;

a first pinion which is meshed with the first rack and rotatably supported by a carrier of the pair of carriers on which the pair of sub-carriers are provided;

a second rack which is provided on a sub-carrier of the pair of sub-carriers along the longitudinal direction of the lift beam;

a second pinion which is meshed with the second rack and rotatably supported by the carrier; and a rotational force transmission member which transmits a rotational force of the first pinion to the second pinion.

7. The work transfer apparatus of the transfer press according to claim 3, wherein the power transmission unit comprises:

a rack which is provided on a lift beam of the pair of lift beams provided with the sub-carriers along the longitudinal direction of the lift beam;

a pinion which is meshed with the rack and rotatably supported by a carrier of the pair of carriers on which the pair of sub-carriers are provided;

a shaft which is rotatably supported at the carrier along the longitudinal direction of the lift beam, and which has a male thread on an outer circumference thereof;

a nut which is provided at a sub-carrier of the pair of sub-carriers, and which is screwed onto the shaft; and rotational force transmission means for transmitting a rotational force of the pinion to the shaft.

8. The work transfer apparatus for the transfer press according to claim 3, wherein the power transmission unit comprises:

a rack which is provided on the pair of lift beams provided with the pair of sub-carriers, along the longitudinal direction of the lift beam;

a pinion which is meshed with the rack and rotatably supported by a carrier of the pair of carriers on which the pair of sub-carriers are provided;

a deformation gear in which a teeth part of the gear is engraved on an outer arc portion of a sector, wherein the teeth part is meshed with one of the pinion and an idle gear for transmitting a rotational force of the pinion;

a rotary shaft provided at a center of the sector arc that is rotatably supported at the first carrier;

a first lever having a first end rotatably attached to a sub-carrier of the pair of sub-carriers, and a second end rotatably supported at the carrier, movably only in an up-and-down direction; and a second lever having a first end fixed to the rotary shaft of the deformation gear, and a second end rotatably attached between the first end and the second end of the first lever by a shaft.

9. The work transfer apparatus for the transfer press according to claim 3, wherein said power transmission unit comprises:

a rack which is provided at a lift beam of the pair of lift beams provided with the sub-carriers along the longitudinal direction of the lift beam, a pinion which is meshed with the rack and rotatably supported by a carrier of the pair of carriers on which the pair of sub-carriers are provided;

a first pulley fixed to the pinion with a shaft;

second pulleys rotatably supported at both end regions of the carrier in the longitudinal direction of the lift beam; and an endless belt which is wound around the first pulley and the second pulleys;

wherein a sub-carrier of the pair of sub-carriers is connected to the endless belt between the second pulleys.

10. A work transfer apparatus for a transfer press, comprising:

at least one pair of lift beams provided in parallel with a work transfer direction to be movable up and down;

at least one pair of carriers which are provided at each of the at least one pair of lift beams, and which are driven by a linear motor to be movable along a longitudinal direction of the pair of lift beams:

a pair of guides provided on at least one of the at least one pair of carriers;

a pair of sub-carriers which are provided on the pair of carriers along the pair of guides, and which are movable in a carrier moving direction;

a driving source to provide a carrier driving force directly to the carriers to move the carriers alone the longitudinal direction of the at least one pair of lift beams;

a power transmission unit which transmits the carrier driving force to the pair of sub-carriers; and a cross bar which is laterally spanned between the pair of sub-carriers, and which is provided with a work holding unit for holding a work;

wherein the carrier driving force is transmitted to the sub-carriers to move the cross bar and each of the sub-carriers to an offset position with respect to a moved position of the pair of carriers in a same direction as the moving direction of each carrier of the pair of carriers.

11. The work transfer apparatus for the transfer press according to claim 10, further comprising an additional cross bar laterally spanned directly between an additional pair of carriers.

12. The work transfer apparatus for the transfer press according to claim 10, wherein the pair of guides protrude from end portions of the pair of lift beams in the carrier moving direction to guide the pair of sub-carriers, when the pair of carriers provided with the sub-carriers are moved up to substantially the end portions of the pair of lift beams in the longitudinal direction of the pair of lift beams.

13. The work transfer apparatus for the transfer press according to claim 10, wherein the power transmission unit comprises:

a first rack which is provided on a lift beam of the pair of lift beams provided with the sub-carriers along the longitudinal direction of the lift beam;

a first pinion which is meshed with the first rack and rotatably supported by a carrier of the pair of carriers on which the pair of sub-carriers are provided;

a second rack which is provided on a sub-carrier of the pair of sub-carriers along the longitudinal direction of the lift beam;

a second pinion which is meshed with the second rack and rotatably supported by the carrier; and a rotational force transmission member which transmits a rotational force of the first pinion to the second pinion.

14. The work transfer apparatus for the transfer press according to claim 10, wherein the power transmission unit comprises:

a rack which is provided on a lift beam of the pair of lift beams provided with the sub-carriers along the longitudinal direction of the lift beam;

a pinion which is meshed with the rack and rotatably supported by a carrier of the pair of carriers on which the pair of sub-carriers are provided;

a shaft which is rotatably supported at the carrier along the longitudinal direction of the lift beam, and which has a male thread on an outer circumference thereof;

a nut which is provided at a sub-carrier of the pair of sub-carriers, and which is screwed onto the shaft; and rotational force transmission means for transmitting a rotational force of the pinion to the shaft.

15. The work transfer apparatus for the transfer press according to claim 10, wherein the power transmission unit comprises:

a rack which is provided on the pair of lift beams provided with the pair of sub-carriers, along the longitudinal direction of the lift beam;

a pinion which is meshed with the rack and rotatably supported by a carrier of the pair of carriers on which the pair of sub-carriers are provided;

a deformation gear in which a teeth part of the gear is engraved on an outer arc portion of a sector, wherein the teeth part is meshed with one of the pinion and an idle gear for transmitting a rotational force of the pinion;

a rotary shaft provided at a center of the sector arc that is rotatably supported at the first carrier;

a first lever having a first end rotatably attached to a sub-carrier of the pair of sub-carriers, and a second end rotatably supported at the carrier, movably only in an up-and-down direction; and a second lever having a first end fixed to the rotary shaft of the deformation gear, and a second end rotatably attached between the first end and the second end of the first lever by a shaft.

16. The work transfer apparatus for the transfer press according to claim 10, wherein said power transmission unit comprises:

a rack which is provided at a lift beam of the pair of lift beams provided with the sub-carriers along the longitudinal direction of the lift beam;

a pinion which is meshed with the rack and rotatably supported by a carrier of the pair of carriers on which the pair of sub-carriers are provided;

a first pulley fixed to the pinion with a shaft, second pulleys rotatably supported at both end regions of the carrier in the longitudinal direction of the lift beam; and an endless belt which is wound around the first pulley and the second pulleys;

wherein a sub-carrier of the pair of sub-carriers is connected to the endless belt between the second pulleys.

17. A work transfer apparatus for a press for transferring a work within the press or between presses, comprising:

at least one pair of lift beams which are provided in parallel with a work transfer direction and movable up and down, and which include a first lift beam provided on a left side of the work transfer direction and a second lift beam provided on a right side of the work transfer direction;

at least one pair of carriers which are provided at each pair of the at least one pair of lift beams, and which are movable along a longitudinal direction of the lift beams;

a pair of guides provided on at least one of the at least one pair of carriers;

a pair of sub-carriers which are provided along the pair of guides, and which are movable in a carrier moving direction; and a cross bar which is laterally spanned between the pair of sub-carriers, and which is provided with a work holding unit for holding a work;

wherein the pair of guides, which guide the pair of sub-carriers, protrude from end portions of the pair of lift beams in the carrier moving direction, when the pair of carriers provided with the sub-carriers are moved up to substantially the end portions of the pair of lift beans in the longitudinal direction of the lift beams.

* * * * *